US006003637A

United States Patent [19]

Kim et al.

[11] Patent Number: 6,003,637

[45] Date of Patent: Dec. 21, 1999

[54] ELEVATOR CONTROL SYSTEM

[75] Inventors: Yeon Hun Kim, Changwon-si; Jong Gon Lee, Masa-si, both of Rep. of Korea

[73] Assignee: LG Industrial Systems, Co., Ltd., Seoul, Rep. of Korea

[21] Appl. No.: 09/136,407

[22] Filed: Aug. 19, 1998

[30] Foreign Application Priority Data

Aug. 20, 1997 [KR] Rep. of Korea ..... P97-39686
Mar. 31, 1998 [KR] Rep. of Korea ..... P98-11270

[51] Int. Cl.[6] ..... B66B 1/34

[52] U.S. Cl. ..... 187/391; 187/380

[58] Field of Search ..... 187/247, 380, 187/383, 382, 391

[56] References Cited

U.S. PATENT DOCUMENTS 4,497,391 2/1985 Mendelsohn et al. ..... 187/29 R
4,742,893 5/1988 Otala et al. ..... 187/121
4,872,532 10/1989 Tobita et al. ..... 187/121
5,018,604 5/1991 Tanino ..... 187/121

FOREIGN PATENT DOCUMENTS 9612682 3/1988 Rep. of Korea .

*Primary Examiner*—Jonathan Salata

[57] ABSTRACT

The present invention relates to an elevator control system, comprising a plurality of car position indicators and car indicators for displaying a current floor position information of a car; a plurality of hall call buttons and car traveling operating panels; a plurality of floor controllers and car controllers (or car controller group) for controlling an information signal's input/output of a floor or a car, as well as for storing a group identifying information and an individual identifying information; an elevator controller, a hall signal transmitting repeater and a car signal transmitting repeater for relaying an information signal among the controllers; and a plurality of serial communication lines.

32 Claims, 33 Drawing Sheets

DATA FORMAT FOR A SIGNAL TRANSMISSION

DATA FORMAT FOR B SIGNAL TRANSMISSION (GROUP ZONE = 4)

DATA FORMAT FOR B SIGNAL TRANSMISSION (GROUP ZONE = 8)

1F~16F DATA FORMAT FOR A SIGNAL TRANSMISSION

FIG. 11A1
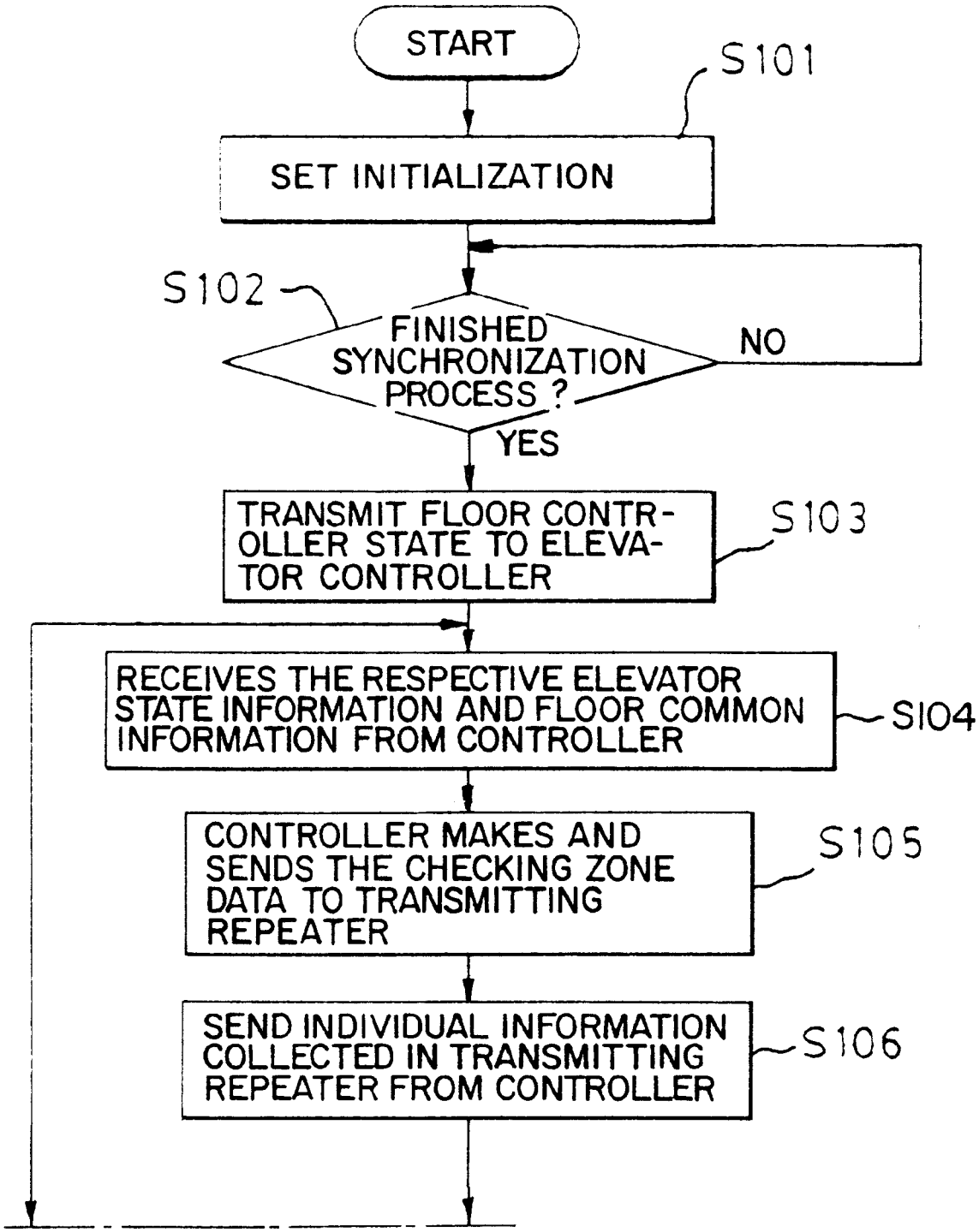

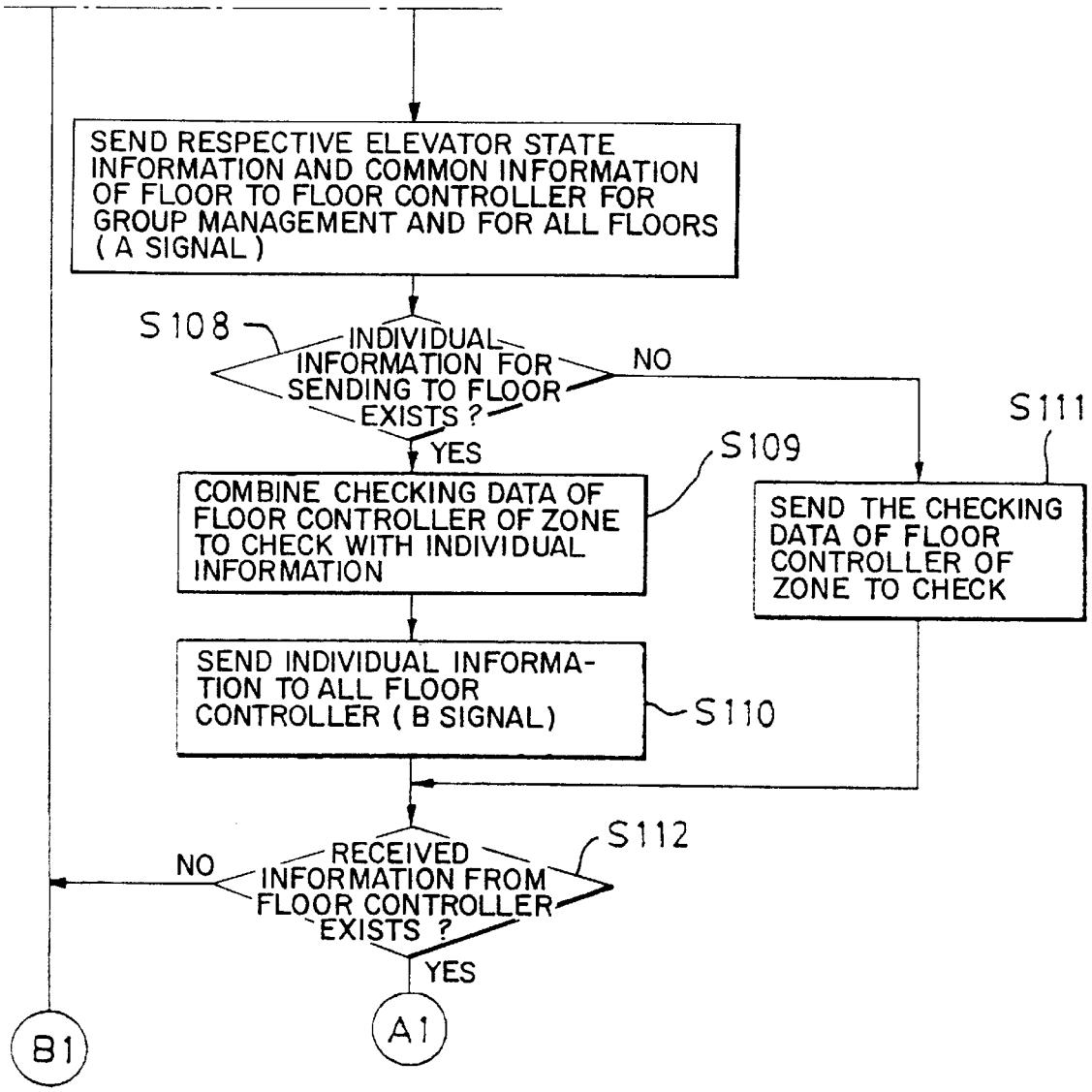
FIG. 11A2

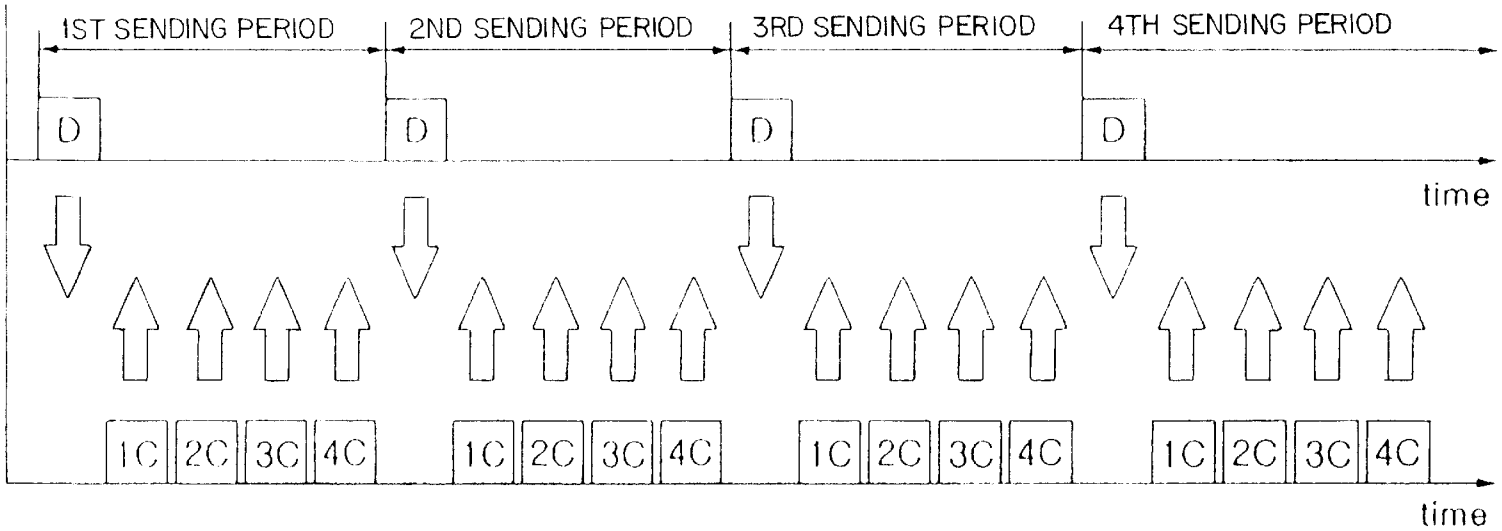
FIG. 14A
CAR SIGNAL TRANSMITTING REPEATER (RESPECTIVE ELEVATOR→CAR
FIG. 14B
CAR STATION (CAR→RESPECTIVE ELEVATOR)
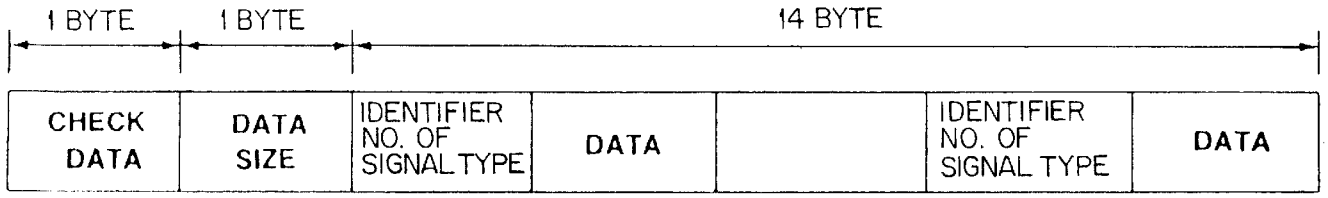
FIG. 14C
DATA FORMAT FOR TRANSMITTING D-SIGNAL
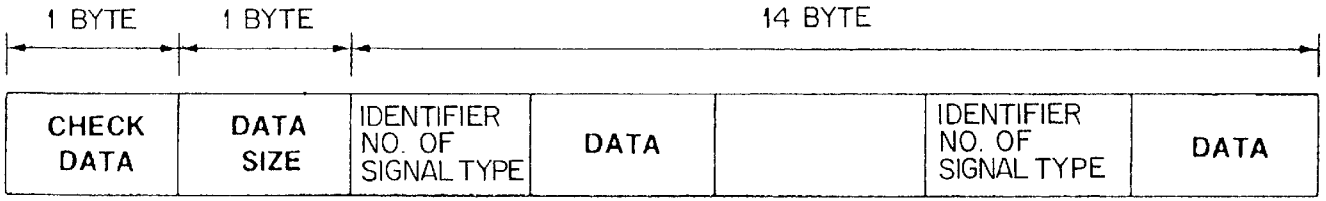
FIG. 14D
1C→4C DATA FORMAT FOR TRANSMITTING D-SIGNAL

ELEVATOR CONTROL SYSTEM

BACKGROUND

1. Technical Field

The present invention relates to a technology to communicate several information in an elevator according to serial transmission methods. Particularly, an elevator control system which transmits the several information for the elevator driving state serially, comprises an elevator controller for controlling an elevator car driving state, a floor controller for controlling inpu/output signals generated from a plurality of floors, and the floor controllers installed in each floor in a building, and a plurality of car controllers for controlling input/output signals generated from in the car. Accordingly, using these devices, the communication efficiency and improvements of the communication reliability among the elevator controller, the floor controllers, and the car controllers can be maximized.

2. Description of the Background Art

In general, the conventional elevator system provided with a number of communication lines which are extended from an elevator machine room to each floor for transmitting a lighting signal of a responding lamp to a hall call signal generated at each floor in a building, and for transmitting the car position indicating signal to the indicator installed in the car.

However, as buildings become higher, and users of an elevator system require more sophisticated services about an elevator control and an indicating method, it was difficult to troubleshoot and repair parts(especially, interfaces between controllers).

To eliminate these disadvantages described above, there is a continued study for reducing numbers of lines installed and for introducing the compatibility of interfaces between the various controllers.

As one of the results of the above-mentioned studies, it is proposed that an elevator controller and a plurality of car controllers be linked together by a common cable, and the signals of respective controller are transmitted using serial transmission method by a microprocessor. However, such a system has a limited communication efficiency capable of handling an elevator system which has sophisticated functions and installed in skyscrapers.

FIG. 1 is a block diagram showing a conventional elevator signal transmission device. In FIG. 1, there are an elevator controller 1 for controlling overall elevator traveling operation upon receiving signals from floor controllers 3A–3C, a hall signal transmitting repeater 2 for sending signals transmitted from the floor controllers 3A–3C to said elevator controller, and for sending the received signals which the elevator controller 1 transmits to the floor controllers 3A–3C installed in each floor in a building via a common transmission line 6, the floor controllers 3A–3C for outputting a traveling information and a responding lamp signal to car position indicators 4A–4C and to hall call button devices 5A–5C received from the hall signal transmitting repeater 2, and for transmitting a call signal input via the call button devices 5A–5C to the hall signal transmitting repeater 2, the car position indicators 4A–4C for displaying a current traveling position of the elevator by receiving a traveling information from the floor controllers 3A–3C, and the floor call button devices 5A–5C for transmitting the call signals to the floor controllers in accordance with the waiting user request, and for displaying that the call signal is registered according to the control of the floor controllers.

FIG. 2 is a block diagram showing another example of a conventional signal transmission device in an elevator system. An elevator controller 1, a hall signal transmitting repeater 2, floor controllers 3A–3C, car position indicators 4A–4C, and hall call button devices 5A–5C are the same as in FIG. 1. In FIG. 2 the elevator system further comprises a car controller 7 for transmitting an output signal of car devices to the hall signal transmitting repeater 2 via the common transmission line 6, and for receiving the traveling information in the elevator from the hall signal transmitting repeater 2, a car indicator 8 for displaying the current traveling position and direction of the elevator by receiving the traveling information from the car controller in the elevator, and a car operating panel 9 for transmitting the generated call signal according to the user request in the car to the car controllers, and for lighting a corresponding floor button by receiving the driving state signal of the responding lamp accordingly. The operation of the signal transmission devices constructed as above will be described with reference to FIG. 3.

The signal transmission among the respective controllers in FIGS. 1, 2 is accomplished by the transmission data format illustrated in FIG. 3. The elevator controller 1, first of all, assigns the floor controller 3C of a first floor, and transmits floor output signals, such as a call responding signal, voice information signal, according to the responding signal received. Thereafter, the elevator controller 1 receives a floor input signal, such as the call button input signal, parking floor designating signal, floor controller check code, and so on from the floor controller 3C.

The elevator controller 1 also assigns the floor controller 3B on a second floor according to the operation described above, transmits the floor output signal, and then receives the floor input signal from the floor controller 3B again. In such ways described above, the elevator controller 1 is capable of successively communicating with the floor controller 3A on the top floor.

Referring back to FIG. 2, in the event that the car controller 7 is linked to the hall signal transmitting repeater 2 via a common transmission line, the elevator controller 1 transmits the output signal to car controller 7 by assigning the respective car controller 7. Thereafter, the elevator controller 1 receives the input signal from the car controller 7 so that the communication among these controllers are accomplished for data exchange.

Upon the completion of sending/receiving operation either between the elevator controller 1 and the car controller 7 or between the elevator controller 1 and the floor controllers 3A–3C for data exchange, respectively, the elevator controller 1 simultaneously transmits a common information of both the car controller 7 and the floor controllers 3A–3C.

The common information might comprise an indicator display information for displaying a current floor position of the car, a direction display lamp information for indicating the up/down traveling direction, a full-car lamp displaying information for indicating that the car passes without stopping since the car is full, a pause lamp information for indicating that the elevator car does not run in a predetermined period of time, and so on.

Upon the completion of the communication from the elevator controller 1 to either the plurality of floor controllers 3A–3C or the car controller 7 for exchange of the individual information and a common information, in other words, from the hall signal transmitting repeater 2 to both the plurality of floor controllers 3A–3C and the car controller 7 in the manner as described above, the various indicator units installed at the floor controllers 3A–3C and the car controller 7, received the corresponding signal to display extra information, such as a weather forecast, a stock market information, an advertising information and so on, in the case of having visual or audible display information units.

In summary, FIG. 3 illustrates the process comprising a first period of time set at will according to the building floor number at which the hall signal transmitting repeater 2 transmits the individual information after assigning successively the respective remote controllers, in other words, the floor controllers 3A–3C and the car controller 7, a second period of transmitting the common information to the remote controllers, and a third period of transmitting various information in accordance with a visual and an audible information process devices. This process is finished as one period, accomplished by repeating above 3 transmission periods.

Since the sending/receiving operation of the individual information for the corresponding floor is performed by assigning the respective devices of each floor during the first period of time, a problem of which the transmission period becomes longer might be partially solved, a constant answering time is guaranteed for taking it granted that the transmission device is slow, and the extra information except the elevator control information can be also transmitted.

After the elevator controller assigns the respective floor controllers, it can detect the failure of the corresponding floor controllers when exchanging the individual information during the first period of time, and after the predetermined period of time has passed, it can service normally in the elevator controller when the failure of the corresponding floor controllers is repaired as in Korean Patent No. 96-12682.

It is natural that the information via the transmission line increases in case that a building becomes higher, devices installed in the elevator system are more various, and the devices which process various kinds of information use the one transmission line. In this case, although the transmission speed should be quick to transmit a lot of information during a predetermined period of time, it is desirable that the transmission speed is slow properly to improve the reliability of communication.

However, in the event that the signal is transmitted by using the conventional communication method as described above even though the building becomes higher, and the elevator runs express, a sending/receiving time of the first period of time is longer in proportion to the number of building floors, the sending/receiving period of time is always assigned to the devices in the elevator system, and actually do not generate the input signals in the process of sending/receiving the individual information on the respective system by designating successively devices of the respective system as well. Accordingly, there are shortcomings that a transmitting time is delayed when the signals are generated in each floor or an indicating time for displaying the driving state of the elevator is delayed because a designation time of the second period of time and the third period of time is assigned late, and it takes much time relatively when the plurality of floor controllers check the failure at every predetermined period of time. These shortcomings are more serious in case of an express elevator.

SUMMARY OF THE INVENTION

As a result, an objective of this invention is to solve the above described shortcomings. The present invention establishes a transmission line for transmitting signals between the elevator controller and the plurality of floor controllers and between the elevator controller and the car controllers, respectively. And a repeater for transmitting a hall signal and a car signal on the transmission line are respectively established. And the elevator controller receives the signals from the floor controllers or the car controllers in which the button input is generated in the common information transmitting period of time during transmitting the common information which is in the plurality of floor controllers and the car controllers via each transmission line and the repeaters in the predetermined period of time. And the elevator controller sends the responding signals to the corresponding floor controller or the car controllers. The object of the present invention provides the elevator control system described above.

The first embodiment of the present invention to achieve the object is to provide an elevator control system for controlling an elevator car which travels in a plurality of floors in a building; a plurality of car position indicators installed in each floor for displaying a current floor position information of the car; a plurality of hall call buttons installed in each floor for enabling a user to call the car and having lamps therein for displaying a call when the call is registered; a plurality of floor controllers having a group information memory means for storing a group identifier representing a group to which the floor controllers belong, a floor controller identifier memory means for storing the identifier of the controller, and a first processor means for controlling the input/output of the floor information signal by generating and outputting a hall call signal responding to the hall call button pushed by the user and by receiving and outputting the car position information signal to the indicators for displaying, the floor controllers being installed in each floor and connected to the indicators installed in the same floor via a transmission line; an elevator controller having a group information memory means for storing the same group identifier as the identifier which is stored in the floor controllers, a floor controller identifier memory means for storing the identifier for each floor controller, a timer means for outputting a timing signal for transmitting an information signal to the floor controller at each predetermined period of time, a second processor means for outputting an individual information signal of corresponding floor including an indicator lamp lighting signal for displaying of responding to the hall call signal as well as the common information signal of all floors including the car position information signal whenever the output from the timer means is generated, and a group selecting signal generating means for generating a group information signal selected by the second processor means among a group information stored in the group information memory means and providing the second processor means with selected group information signal to be included in the individual information signal; a hall signal transmitting repeater for sending the information signal received from the elevator controller and transmitting the information signal received from the floor controller; and, a serial transmission line connected to the plurality of floor controllers commonly and providing a signal transmission line between the hall signal transmitting repeater and the plurality of floor controllers.

The second embodiment of the present invention to achieve the object is an elevator control system for controlling an elevator car which travels in a plurality of floors in a building; a plurality of car position indicators installed in each floor for displaying a current floor position information of the car; a plurality of hall call buttons installed in each floor for enabling a user to call the car and having lamps therein for displaying a call when the call is registered; a plurality of floor controllers having a group information memory means for storing a group identifier representing a group to which the floor controllers belong, a floor controller identifier memory means for storing the identifier of the controller, and a first processor means for controlling the input/output of the floor information signal by generating and outputting a hall call signal responding to the hall call button pushed by the user and by receiving and outputting the car position information signal to the indicators for displaying, the floor controllers being installed in each floor and connected to the indicators installed in the same floor via a transmission line; a car operating panel installed in the car and having a plurality of buttons and switches for operating of car traveling; an indicator means installed in the car for displaying an information including a full load displaying information; a plurality of car controllers connected to the car operating panel and the indicator means for outputting the information signal to them or outputting after receiving the information signal from them, the car controllers having an identifier memory means for storing an identifier information which is preset about itself; an elevator controller having a group information memory means for storing the same group identifier for each floor controller as stored in the floor controllers, an identifier (ID) information memory means for storing the identifier information of each floor controller, a first timer means for outputting a timing signal of transmitting an information signal to the floor controller at each predetermined period of time, a memory means for storing a predetermined identifier information for each car controller, an information identifier (ID) memory means for storing the predetermined identifier information representing a content of corresponding information signal to transmit to the car controller, a second timer means for outputting a timing signal of transmitting the information signal to the car controller at each predetermined period of time, a second processor means for generating and outputting an indication information signal of the indicator means in a car as well as a responding signal to an operating input signal of the car operating panel and outputting the identifier information stored in the information identifier (ID) memory means as well as the identifier information stored in the memory means whenever a timing signal is received from the second timer means, a third processor means for generating the individual information signal for each floor including a responding lamp lighting signal to the hall call signal as well as a common information signal for all floors including the car position information signal and outputting said individual and common information signal whenever the timing signal is received from the first timer means, and a group selecting signal generating means for generating a corresponding group selecting signal which is chosen by the third processor means among the group identifier information stored in the group information memory means and providing the second processor means with the group selecting signal to be included in the individual information signal; a hall signal transmitting repeater for sending the information signal received from the elevator controller and transmitting the information signal received from the floor controller to the elevator controller; a first serial transmission line connected to a plurality of the floor controllers commonly for providing a signal transmission line between the hall signal transmitting repeater and the plurality of the floor controllers; a car signal transmitting repeater for sending an information signal received from the elevator controller and transmitting the information signal received from the plurality of car controllers to the elevator controller; and, a second serial transmission line connected to the plurality of car controllers commonly, for providing a signal transmission line between the car signal transmitting repeater and the plurality of the car controllers.

The third embodiment of the present invention to achieve the object is an elevator control system for controlling a pair of elevator cars which travel in a plurality of floors in a building; a pair of car position indicators installed in each floor for displaying a current floor position information of a pair of cars; a plurality of hall call buttons installed in each floor commonly to the two cars for enabling a user to call the car and having lamps therein for displaying a call when the call registered; a plurality of floor controllers having a group information memory means for storing a group identifier information representing a group to which the floor controllers belong, a floor controller identifier memory means for storing the identifier information of itself, and a first processor means for controlling the input/output of the floor information signal by generating and outputting a hall call signal responding to the hall call button pushed by the user and by receiving and outputting the car position information signal to the indicators for displaying, the floor controllers being installed in each floor and connected to the indicators installed in the same floor via a transmission line; a car operating panel installed in the car and having a plurality of buttons and switches for operating of car traveling; a car indicator installed in the car for displaying an information including a full load displaying information; a first car controller group and the second car controller group including a plurality of car controllers connected to the car operating panel and the car indicator for outputting an information signal to them or for receiving an information signal from them, wherein each car controller has an identifier information memory means for storing a predetermined identifier information, a pair of elevator controllers, wherein each has a group information memory means for storing the same group identifier information as the information stored in the floor controllers, an identifier (ID) information memory means for storing the floor controller identifier information for each floor controller, a first timer means for outputting a timing signal for transmitting the information signal to the floor controller at each predetermined period of time, a memory means for storing a car controller identifier information which is predetermined for each car controller, an information identifier (ID) memory means for storing a predetermined identifier information representing a content of corresponding information signal to transmit to the car controller, a second timer means for outputting a timing signal for transmitting the information signal to the car controller at each predetermined period of time, a second processor means for generating and outputting the identifier information signal stored in the information identifier (ID) memory means as well as the identifier information signal stored in the memory means whenever a timing signal is received from the second timer means together with an indicating information signal of the car indicator as well as an responding signal to a operating input signal from the car operating panel, a third processor means for outputting an individual information signal whenever the timing signal is received from the first timer means by generating the individual information signal for each floor including an hall call lamp lighting signal displaying a registration for the hall call signal as well as a common information signal for all floors including the car position information signal, and a group selecting signal generating means for providing a group selecting signal to the second processor means to be included in the individual information signal by generating the corresponding group selecting signal which is chosen by the third processor means among the group identifier information stored in the group information memory means; a pair of hall signal transmitting repeaters, wherein each of repeater transmits the information signal received from one elevator controller to the other elevator controller and transmits the information signal received from the other elevator controller to said one elevator controller while transmitting the information signal received from the floor controller to the respective elevator controller; a first serial transmission line for providing a signal transmission line between a pair of the hall signal transmitting repeaters and the plurality of floor controllers and for connecting a plurality of the floor controllers and a pair of the hall signal transmitting repeaters commonly; a pair of car signal transmitting repeaters for transmitting an information signal received from the elevator controller to the corresponding car controller respectively, and transmitting the information signal received from the plurality of car controllers to the elevator controller; and, the second and third serial transmission lines to which the plurality of car controllers in the first and the second car controller group are connected commonly, for providing the second and the third serial transmitting lines between the car signal transmitting repeater and the plurality of car controllers, respectively.

The fourth embodiment of the present invention to achieve the object is an elevator control system for controlling a plurality of elevator cars which travel commonly in a plurality of floors in a building; a plurality of car position indicators installed in each floor for displaying a current floor position information of the cars; a plurality of hall call buttons installed in each floor for enabling a user to call the car and having lamps therein for displaying a call when the call is registered; a plurality of floor controllers having a group information memory means for storing a group identifier information representing a group to which the floor controllers belong, a floor controller identifier memory means for storing the identifier information of itself, and a first processor means for controlling the input/output of the floor information signal by generating and outputting a hall call signal responding to the hall call button pushed by the user and by receiving and outputting the car position information signal to the indicators for displaying, the floor controllers being installed in each floor and connected to the indicators installed in the same floor via a transmission line; a car operating panel installed in the car and having a plurality of buttons and switches for operating of car traveling; a car indicator installed in the car for displaying an information including a full load displaying information; a plurality of car controller groups including a plurality of car controllers connected to the car operating panel and the car indicator for outputting an information signal to them or for receiving an information signal from them, wherein each car controller has an identifier information memory means for storing a predetermined identifier information; a plurality of elevator controllers, wherein each has a group information memory means for storing the same group identifier information as the information stored in the floor controllers, an identifier (ID) information memory means for storing the floor controller identifier information for each floor controller, a first timer means for outputting a timing signal for transmitting the information signal to the floor controller at each predetermined period of time, a memory means for storing a car controller identifier information which is predetermined for each car controller, an information identifier (ID) memory means for storing a predetermined identifier information representing a content of corresponding information signal to transmit to the car controller, a second timer means for outputting a timing signal for transmitting the information signal to the car controller at each predetermined period of time, a second processor means for generating and outputting the identifier information signal stored in the information identifier (ID) memory means as well as the identifier information signal stored in the memory means whenever a timing signal is received from the second timer means together with an indicating information signal of the car indicator as well as an responding signal to a operating input signal from the car operating panel, a third processor means for outputting an individual information signal whenever the timing signal is received from the first timer means by generating the individual information signal for each floor including an hall call lamp lighting signal displaying a registration for the hall call signal as well as a common information signal for all floor including the car position information signal, and a group selecting signal generating means for providing a group selecting signal to the second processor means to be included in the individual information signal by generating the corresponding group selecting signal which is chosen by the third processor means among the group identifier information stored in the group information memory means; a plurality of the second hall signal transmitting repeaters for transmitting the information signal received from one elevator controller while transmitting the information signal received from the other elevator controllers to the one elevator controller and transmitting the information signal received from the floor controller to the elevator controller; a plurality of the first serial transmission line connected to a plurality of the floor controllers and the hall signal transmitting repeaters commonly, for providing a signal transmission line between the hall signal transmitting repeaters and the floor controllers, a plurality of car signal transmitting repeaters for sending an information signal received from the elevator controller to the corresponding car controller, respectively and transmitting the information signal received from the plurality of car controllers to the elevator controller; a group managing controller having a car assigning means for outputting an assigning signal by choosing a car to service to the received hall call signals among a plurality of cars according to a priority which is determined by predetermined assigning program; a group managing signal repeater for transmitting the hall call signal to the group managing controller and for outputting the assigning signal by receiving from the group managing controller; a third hall signal transmitting repeater for relaying an information signal between the group managing signal repeater and a plurality of the first hall signal transmitting repeater for relaying the information signal transmission between them, a third serial communication line for providing a common signal transmitting line between the third hall signal transmitting repeater and a plurality of the first hall signal transmitting repeater; and, a fourth serial communication line for providing a common signal transmitting line between the group managing signal repeater and a plurality of the second hall signal transmitting repeaters by being connected commonly.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which:

FIGS. 11A1, 11A2, 11B and 11C are together a signal flow chart of the hall signal transmitting repeater according to the invention;

FIGS. 14A, 14B are together an illustration about the signal transmission method in the car;

FIGS. 14C, 14D are together a diagram of a data format of D signal, and 1C–4C signals;

DETAILED DESCRIPTION

The present invention will now be described in detail referring to the attached drawings and the preferred embodiments.

Figure 1:
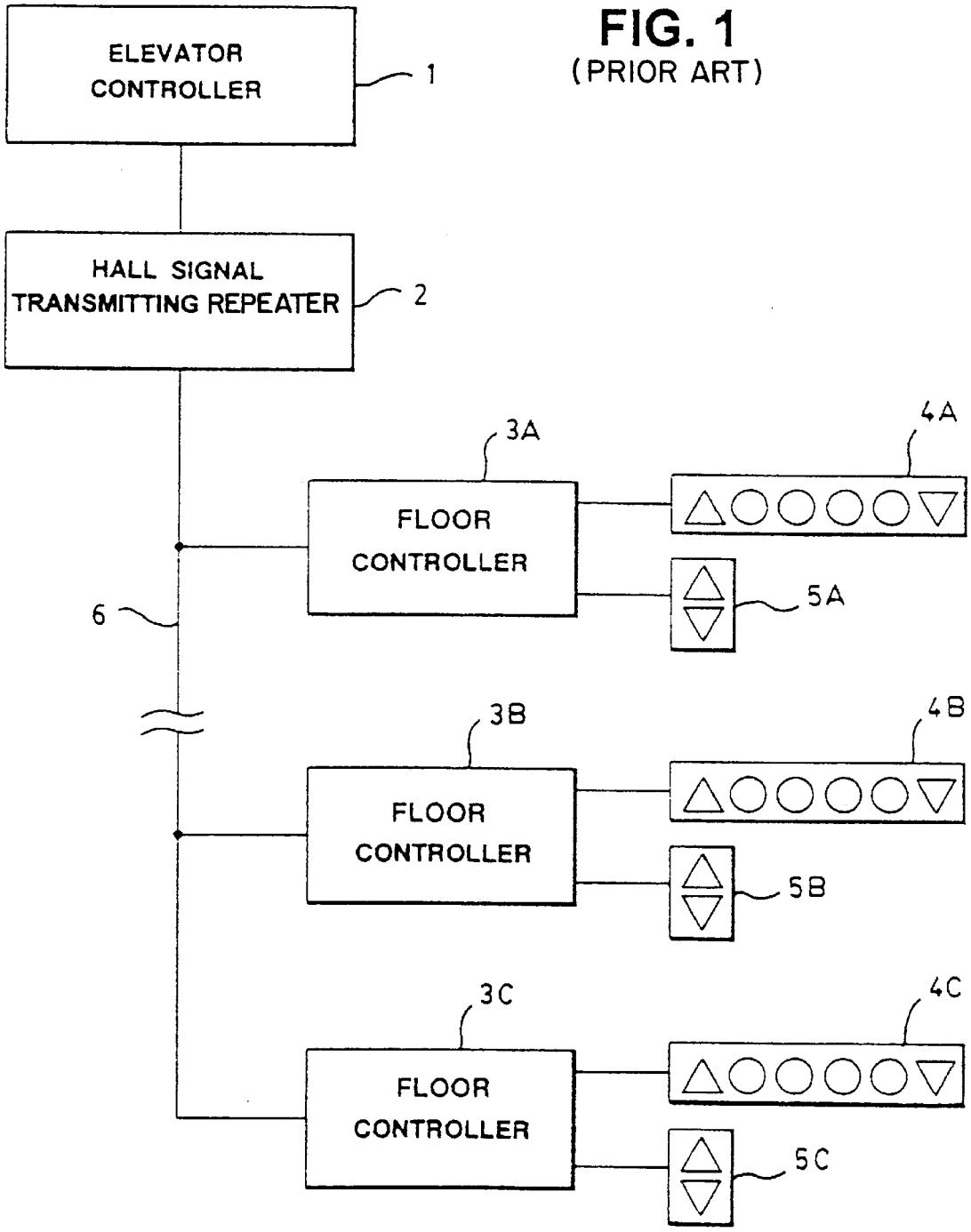
FIG. 1 (PRIOR ART)
FIG. 1 is a block diagram of the elevator control system according to the conventional art.
Figure 2:
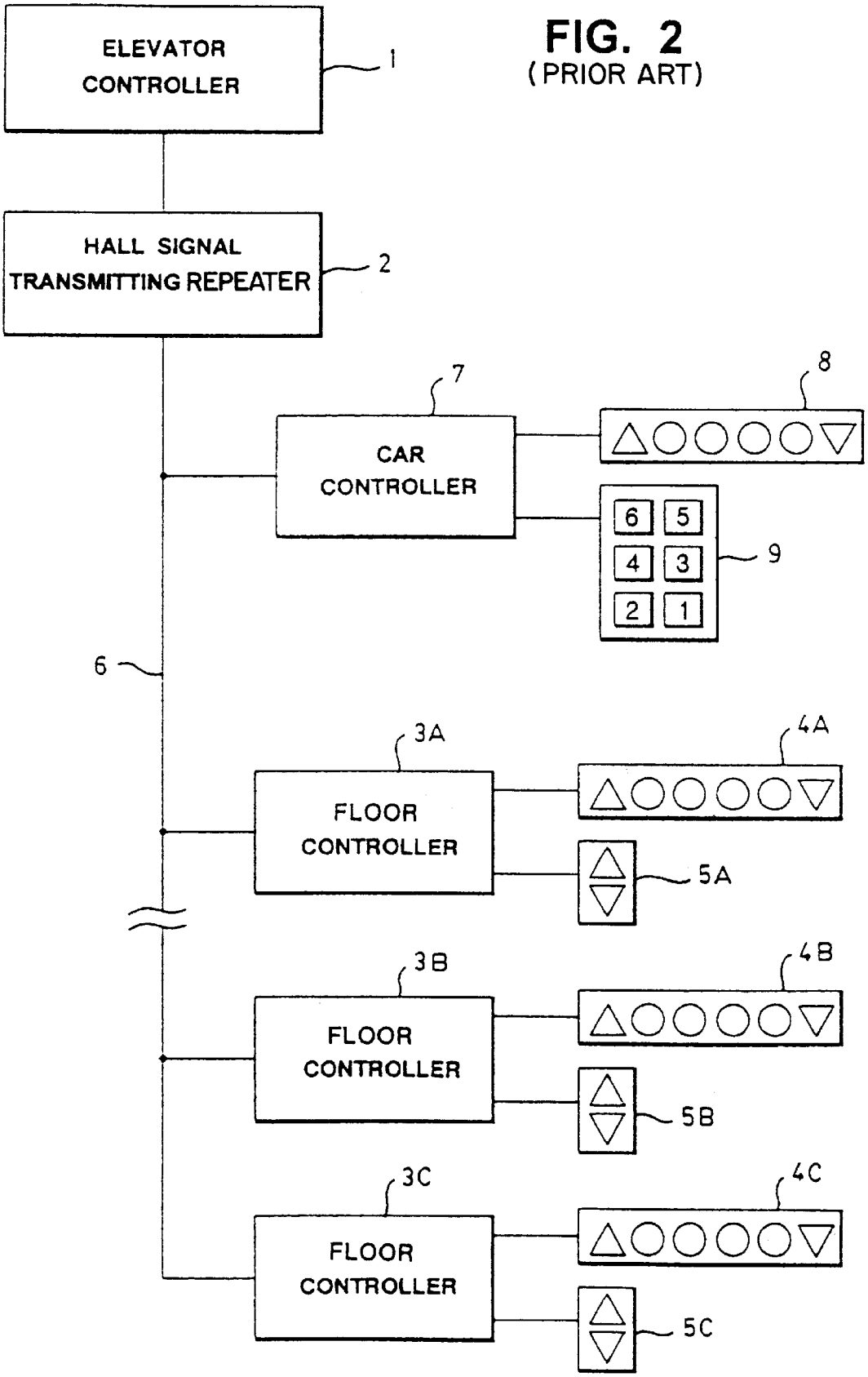
FIG. 2 (PRIOR ART)
FIG. 2 is a block diagram of the other elevator control system according to the conventional art.
Figure 3:
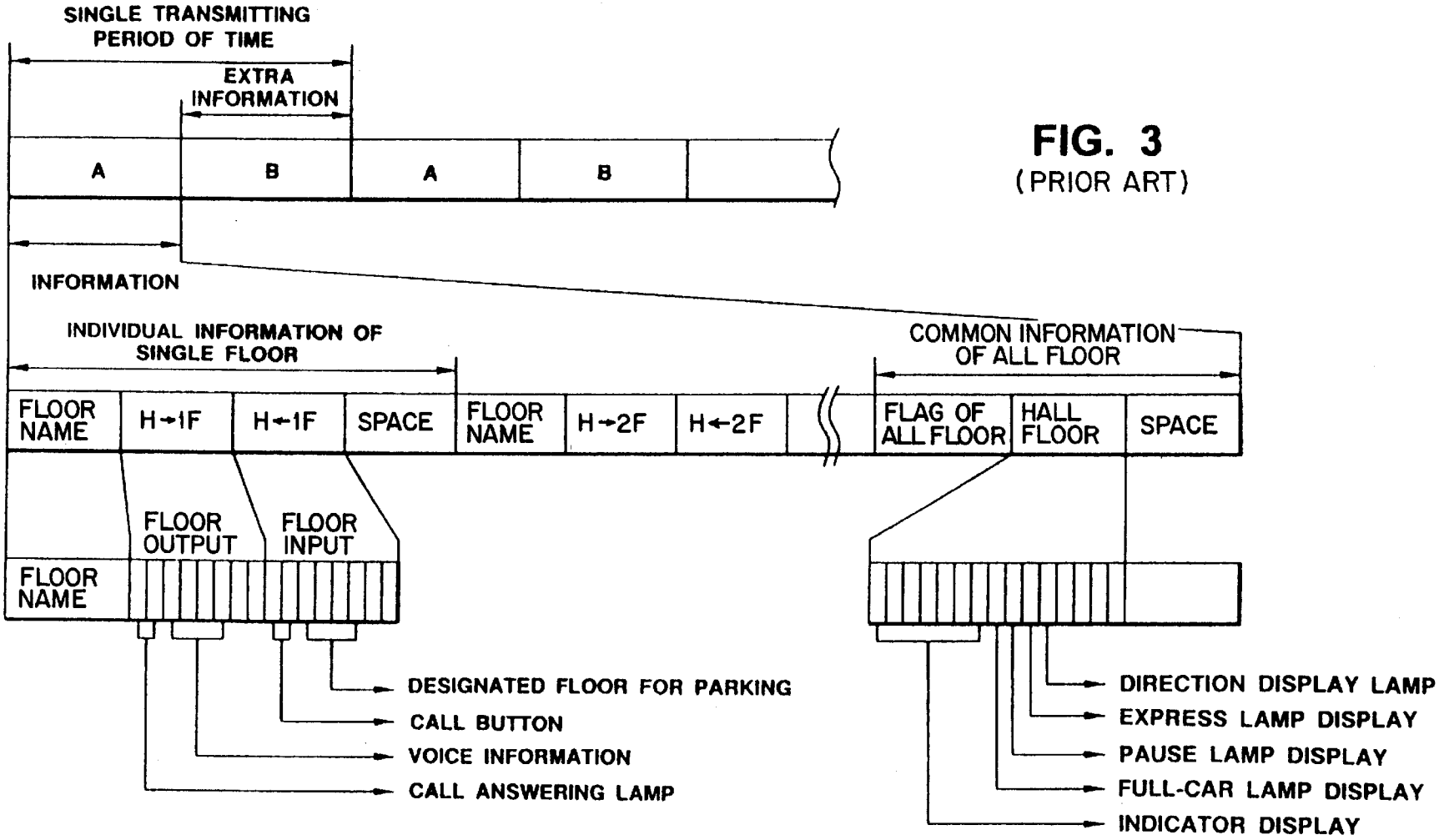
FIG. 3 (PRIOR ART)
FIG. 3 is a diagram of a data format for transmitting signals of the elevator system according to the prior art.
Figure 4:
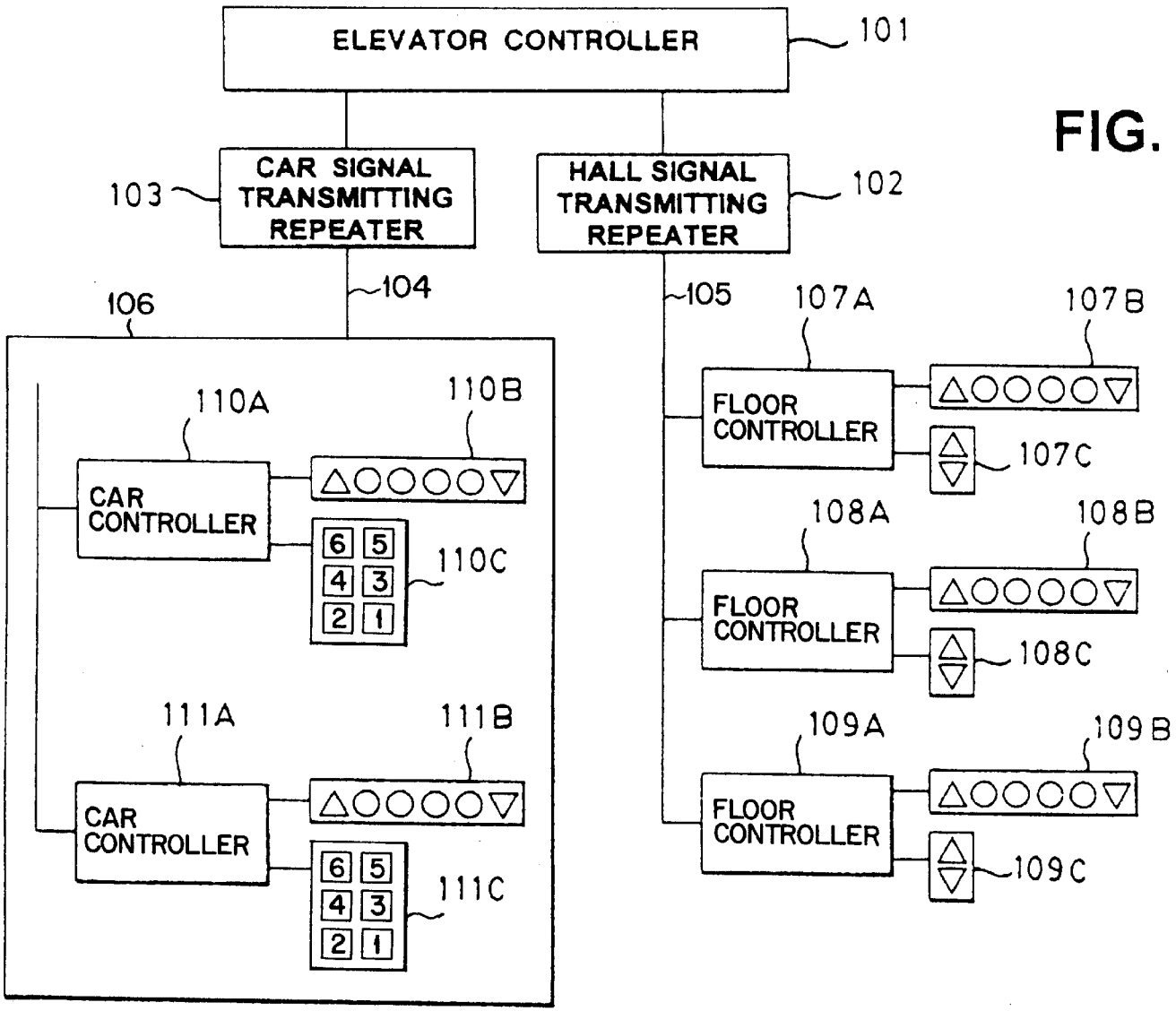
FIG. 4 is a block diagram of an embodiment of the elevator control system according to the invention.

FIG. 4 is a block diagram of an embodiment of the elevator control system according to the invention.

The elevator control system for controlling the elevator car which is traveling in a plurality of floors in the building shown in FIG. 4, has a plurality of car position indicators 107B–109B for displaying a current floor position information of the car in the each floor; a plurality of hall call buttons 107C–109C for calling the car by user and having a lamp therein for displaying that the call is registered; and a plurality of floor controllers 107A–109A for controlling a floor information input/output by connecting via the car position indicator and the hall call button and the signal line which are installed in the same floor.

Figure 8A:
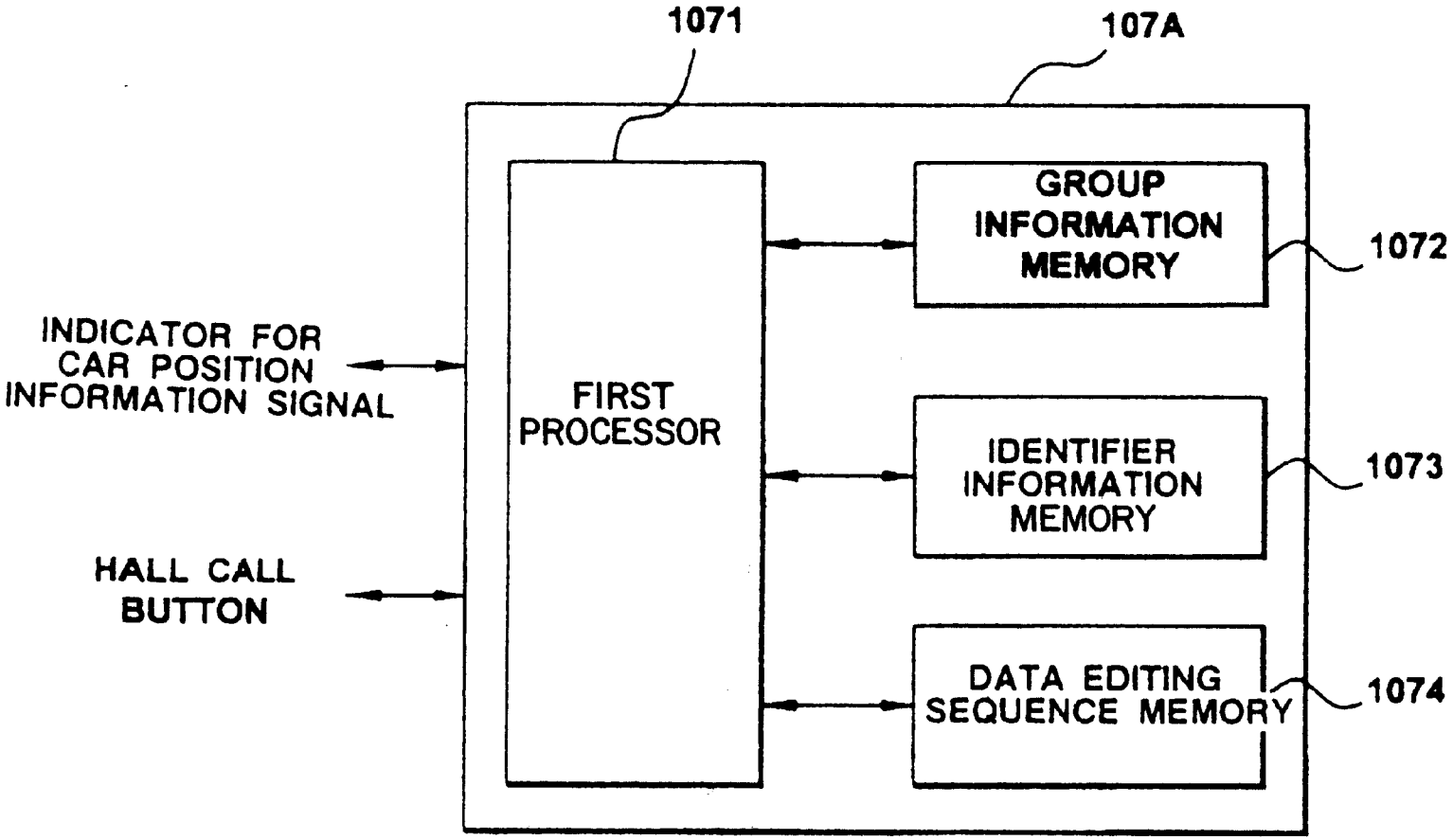
FIGS. 8A–8D are together a block diagram of an embodiment according to the present invention showing an inner configuration of the floor controller and the car controllers and the elevator controller, respectively.

Shown in FIG. 8A, the plurality of floor controllers 107A–109A have a group information memory 1072 for storing a group identifier information about the group setting of a floor controllers, an identifier information memory 1073 for storing an identifier information of itself, and a first processor 1071 for generating and outputting a hall call signal in response to the hall call button pushed by the user and for controlling an information signal input/output of the floor which includes the car position information signal to be displayed on the indicator, respectively.

Herein, the plurality of floor controllers may be formed a group of 4 or 8 or more depending on the traveling floor number of the elevator car.

The floor controllers 107A–109A further includes a data editing sequence memory 1074 for storing an editing sequence data which is the same as an editing sequence data stored in the elevator controller.

Additionally, the control system has a car operating panels 110C, 111C which are installed in the car, including a button and a switch for a plurality of traveling operations; indicators 110B, 111B which are installed in the car for displaying the information including a current floor position information of the car or an information of a full car; and car controllers 110A, 111A for controlling an information input/output of the car by being connected in the car operating panel and the car indicator, respectively.

Figure 8B:
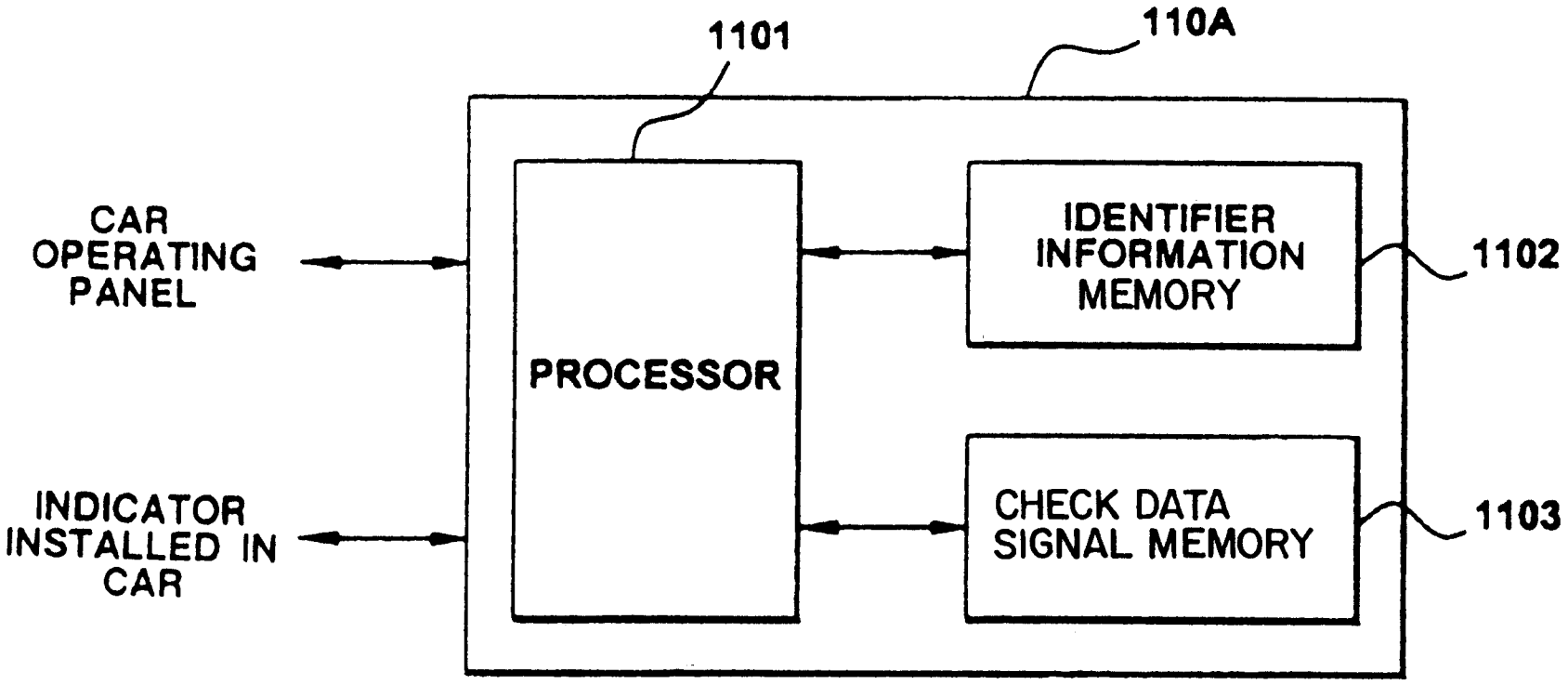

Shown in FIG. 8B the car controllers 110A, 111A may include a processor means 1101 for outputting an information signal to the car operating panel and the car indicators, or outputting the information signal from them, respectively, an identifier information memory 1102 for storing an identifier information which is predetermined for each controller, and a check data signal memory 1103 for outputting a check data signal received from the elevator controller at the previous period of time when an information signal is sent at this time.

Figure 8C:
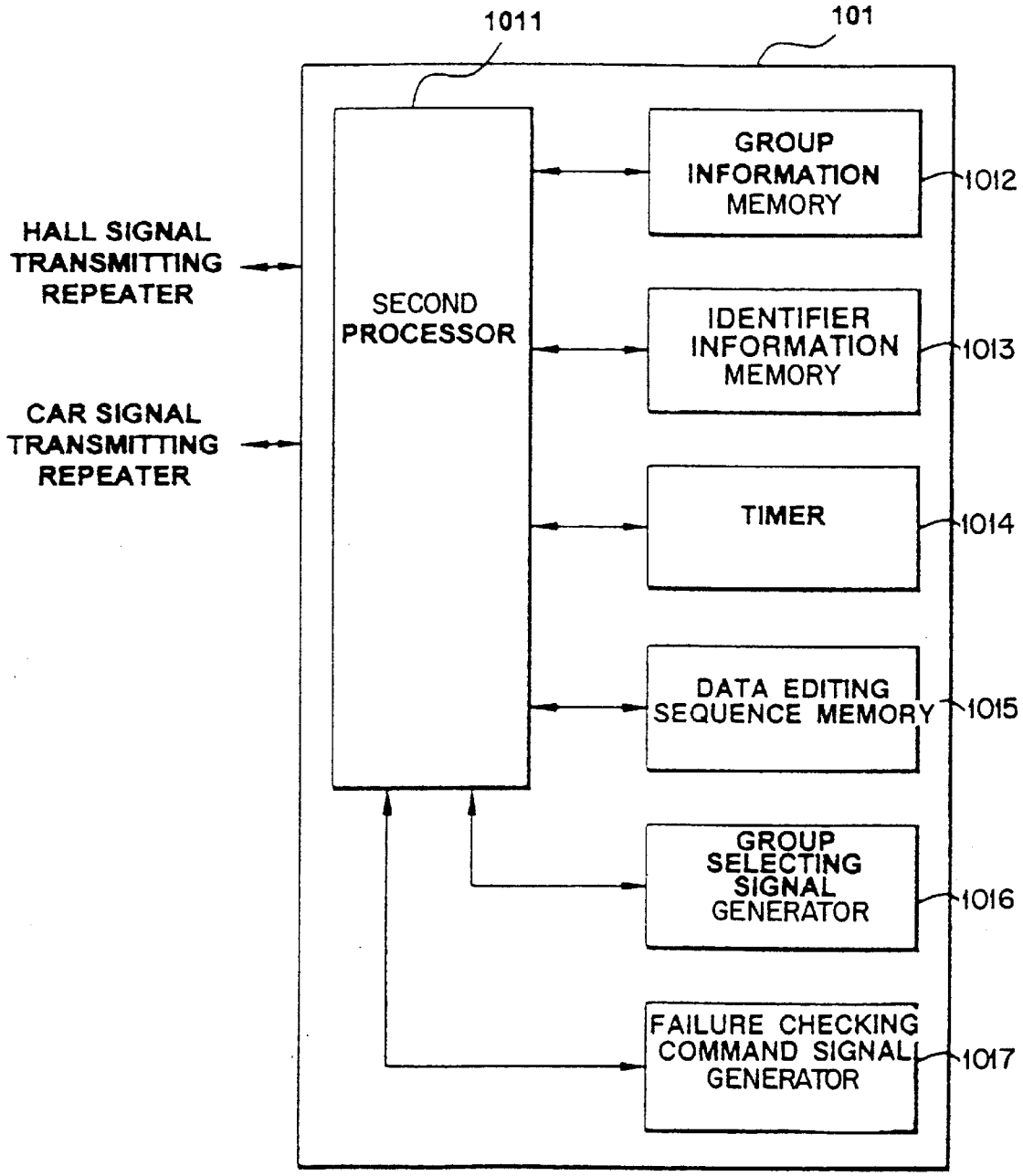

Moreover, shown in FIG. 8C, the control system includes the elevator controller 101 having a group information memory 1012 for storing the same group identifier information as the information which is stored in the floor controllers, an identifier information memory 1013 for storing the identifier information of each floor controller, a timer 1014 for outputting a timing signal of transmitting the information signal to the floor controller at each predetermined period of time, a second processor 1011 for outputting an individual information signal of each floor including the indicating lamp lighting signal for displaying the registration responding to the hall call signal as well as the common information signal to all floors including the car position information signal whenever the output from the timer is generated, and a group selecting signal generator 1016 for providing a group selecting information signal selected among a group information stored in the group information memory means by the second processor means to be included in the individual information signal.

And the elevator controller 101 further includes a failure checking command signal generating means 1017 for generating and outputting a failure checking command signal for checking the failure of the floor controllers, and a data editing sequence memory 1015 for storing the editing sequence of each data included in the common information signal according to the data content.

Additionally, the common information signal is at least one of the car position information signal, a direction lighting signal for confirming an up/down traveling direction chosen by users, a car driving state information signal, a car load state information signal, and a car arrival forecasting information signal, and the individual information signal is at least one of a floor controller group selecting signal, a floor controller identifier signal, a lighting signal of hall call button, and a hall call button checking command signal.

The control system also includes a hall signal transmitting repeater 102 for sending the information signal received from the elevator controller and transmitting the information signal received from the floor controller, the first serial transmission line 105 connected with the plurality of floor controllers commonly, providing a signal transmission line between the hall signal transmitting repeater and the plurality of floor controllers, a car signal transmitting repeater 103 for sending an information signal received from the elevator controller and transmitting the information signal received from the plurality of car controllers to the elevator controller, and the second serial transmission line 104 connected with the plurality of floor controllers commonly, for providing a signal transmission line between the car signal transmitting repeater and the plurality of car controllers.

Figure 5:
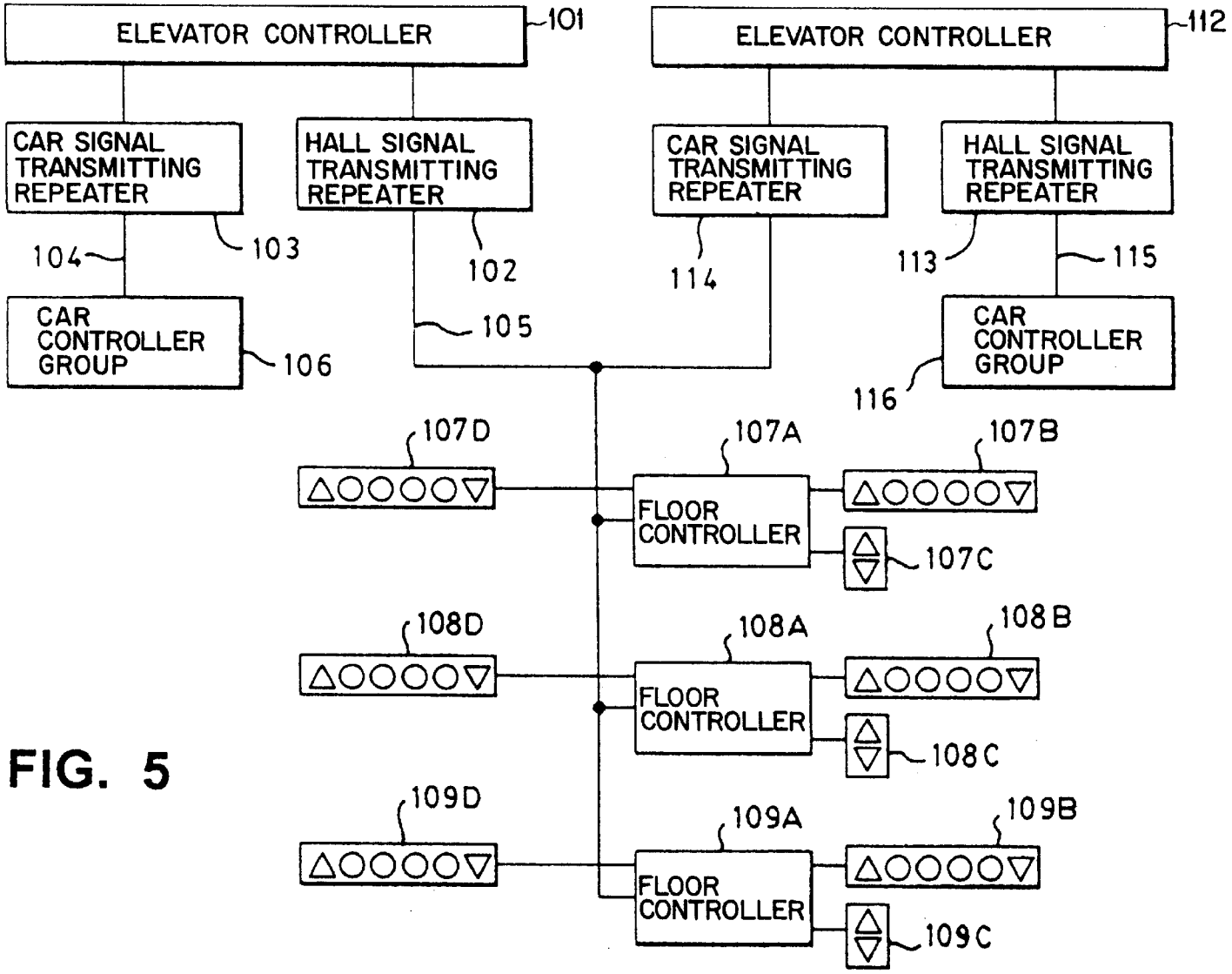
FIG. 5 is another embodiment diagram of the elevator control system according to the invention.

FIG. 5 is another embodiment diagram of the elevator control system according to the invention, and shows the elevator system for controlling a pair of elevator cars which is driving in a plurality of floors commonly in the same building.

The control system shown in this figure further includes a plurality of car position indicators 107D–109D which are added in the configuration of the FIG. 4, and hall call buttons 107C–109C are commonly installed in 2 cars in each floor.

And the plurality of floor controllers 107A–109A which are commonly installed in 2 cars in each floor, are commonly connected with a pair of indicators which are installed in the same floor via a signal line.

The control system also includes a first controlling group 106 and the second controlling group 116 which are comprised of a plurality of car controllers described above.

And the control system includes a pair of elevator controllers 101, 112 which are installed for the corresponding cars, respectively.

Figure 8D:
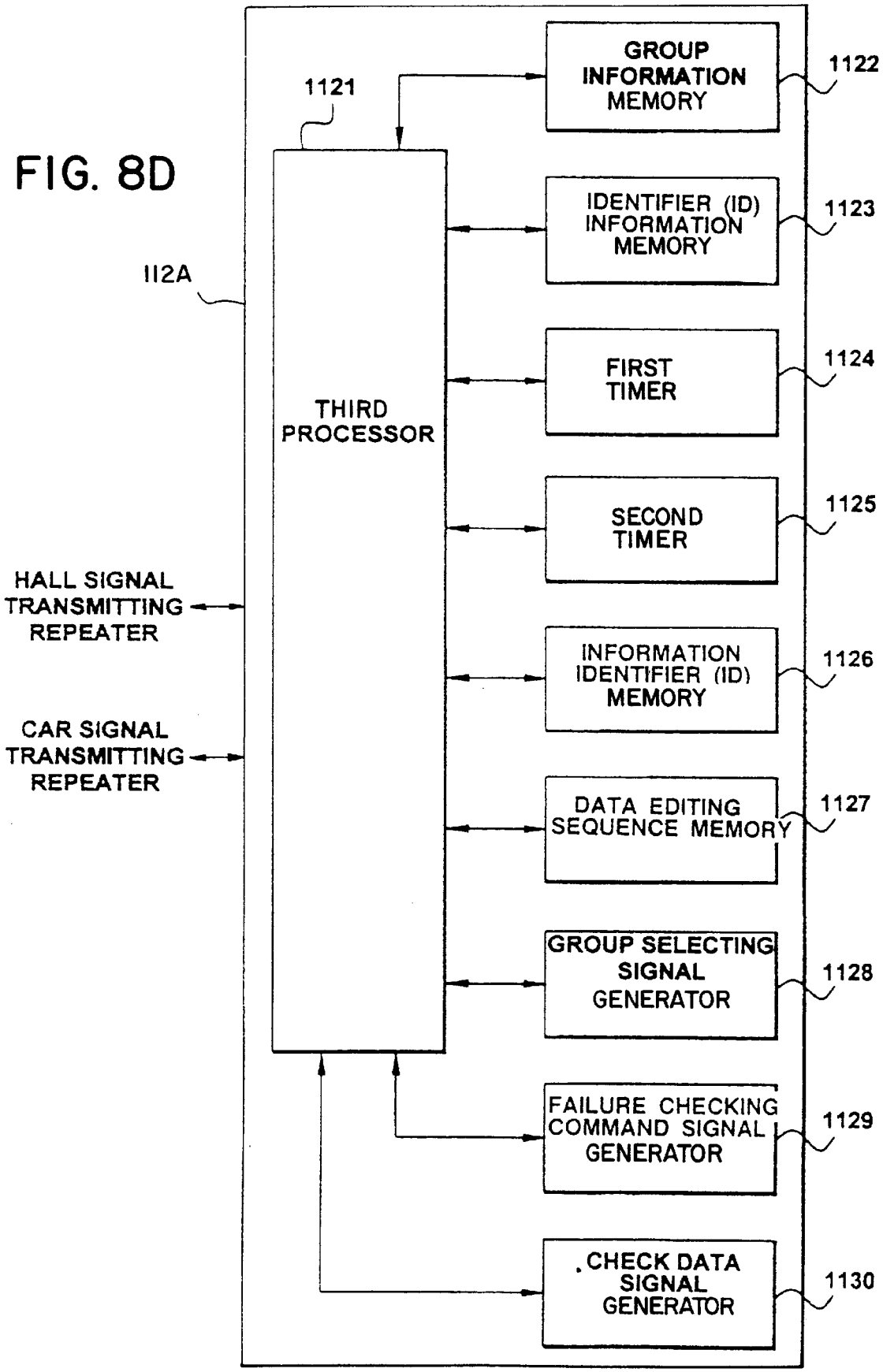

The elevator controller 101, 112 shown in FIG. 8D may include a group information memory 1122 for storing the same group identifier information of each floor controller set into the predetermined each group as the information which is stored in the floor controllers, an identifier (ID) memory 1123 for storing the identifier information about each floor controller, the first timer 1124 for outputting a timing signal for transmitting the information signal to the floor controller at every predetermined period of time, a memory (not shown in FIG. 8D) for storing an identifier information which is predetermined for each car controller, an information identifier (ID) memory 1126 for storing an identifier information according to the content of a corresponding information signal to transmit to the car controller, a second timer 1125 for outputting a timer signal for transmitting the information signal to the car controller at every other period of time which is preset, a third processor 1121 for outputting an identifier information signal whenever the timing signal is received from the first timer by generating the identifier information signal of each floor controller including a responding lamp lighting signal displaying a registration about the hall call signal as well as a common information signal for all floors including the car position information signal, and a group selecting signal generator 1128 for providing a group selecting signal to the second processor to be included in the individual information signal by generating the corresponding group selecting signal which is chosen by the third processor 1121 among the group identifier information stored in the group information memory 1121.

The elevator controllers 101, 112 further include a data editing sequence memory 1127 for storing the editing sequence of each data included in the common information signal according to the data content and a failure checking command signal generator 1129 and a check data signal generating 1130 for outputting a varying check signal whenever an information signal is transmitted to check a failure of the car controllers.

Additionally, the control system includes a pair of hall signal transmitting repeaters 102, 113 for sending the information signal received from the elevator controller, sending the information signal received from the other elevator controller to the elevator controller and transmitting the information signal received from the floor controller, a first serial transmission line 105, in which the plurality of floor controllers and the pair of hall signal transmitting repeaters are connected in the line commonly, providing a signal transmission line between a pair of the hall signal transmitting repeaters and the plurality of floor controllers, a pair of car signal transmitting repeaters 103, 114 for sending an information signal received from the elevator controller to the corresponding car controller, respectively, and transmitting the information signal received from the plurality of car controllers to the elevator controller, and second and third serial transmission lines 104 which the plurality of car controllers according to the first and the second car controlling group are connected commonly, for providing the second and the third serial transmitting lines between the car signal transmitting repeater and the plurality of car controllers, respectively.

Figure 6A:
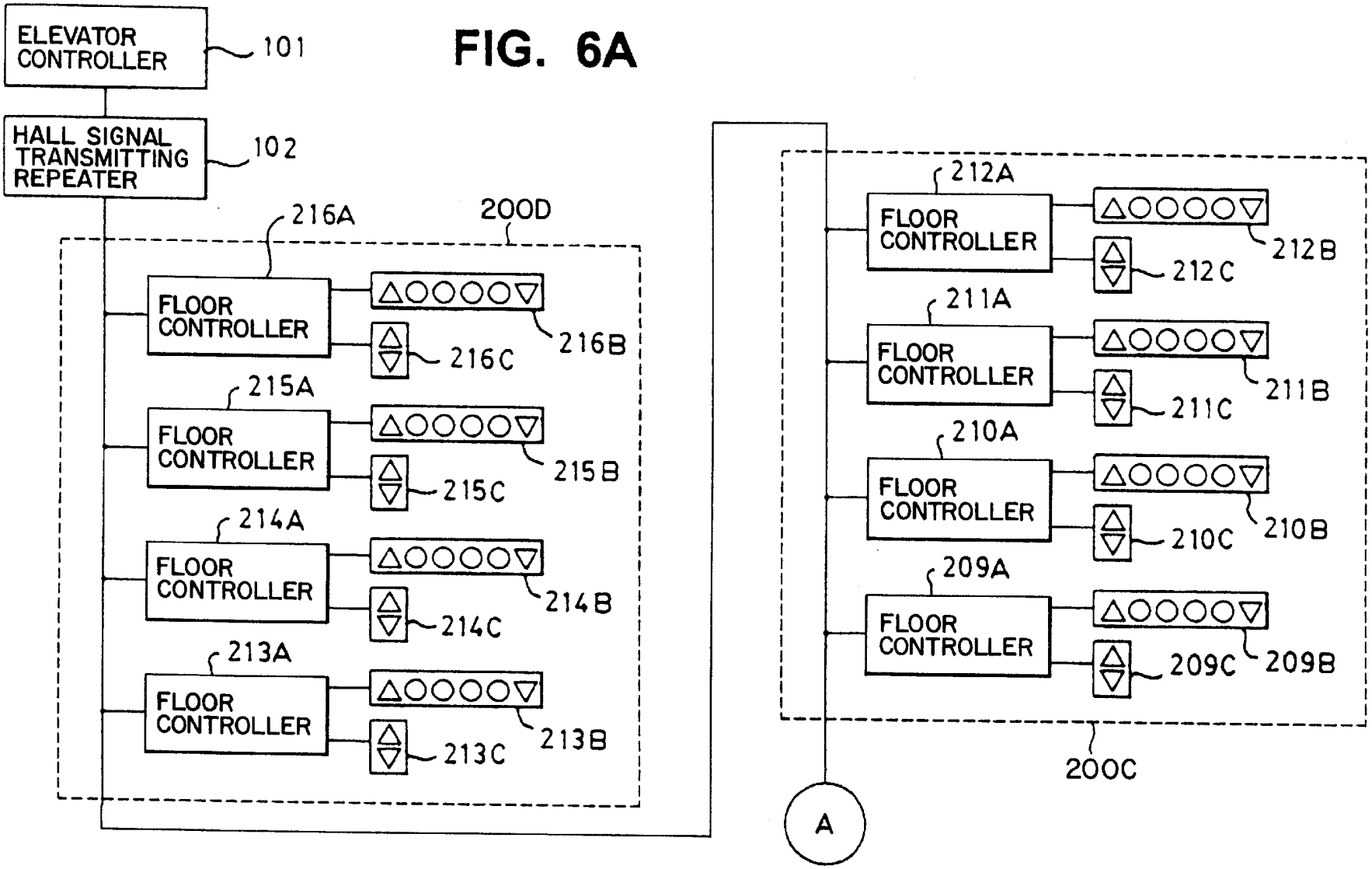
FIGS. 6A, 6B are together a block diagram of an exemplary embodiment about dividing a group zone of the floor controllers according to the invention.
Figure 6B:
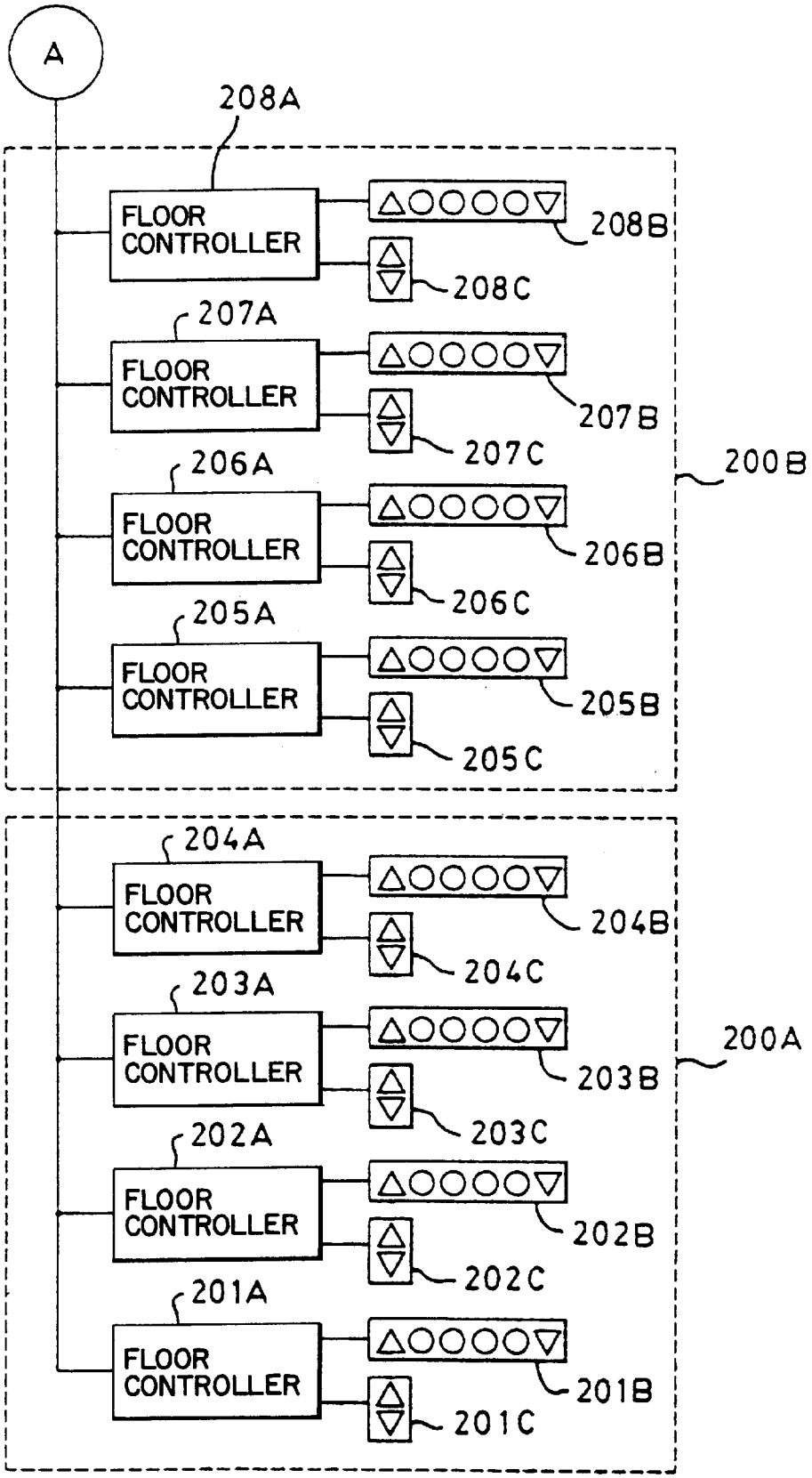
Figure 7A:
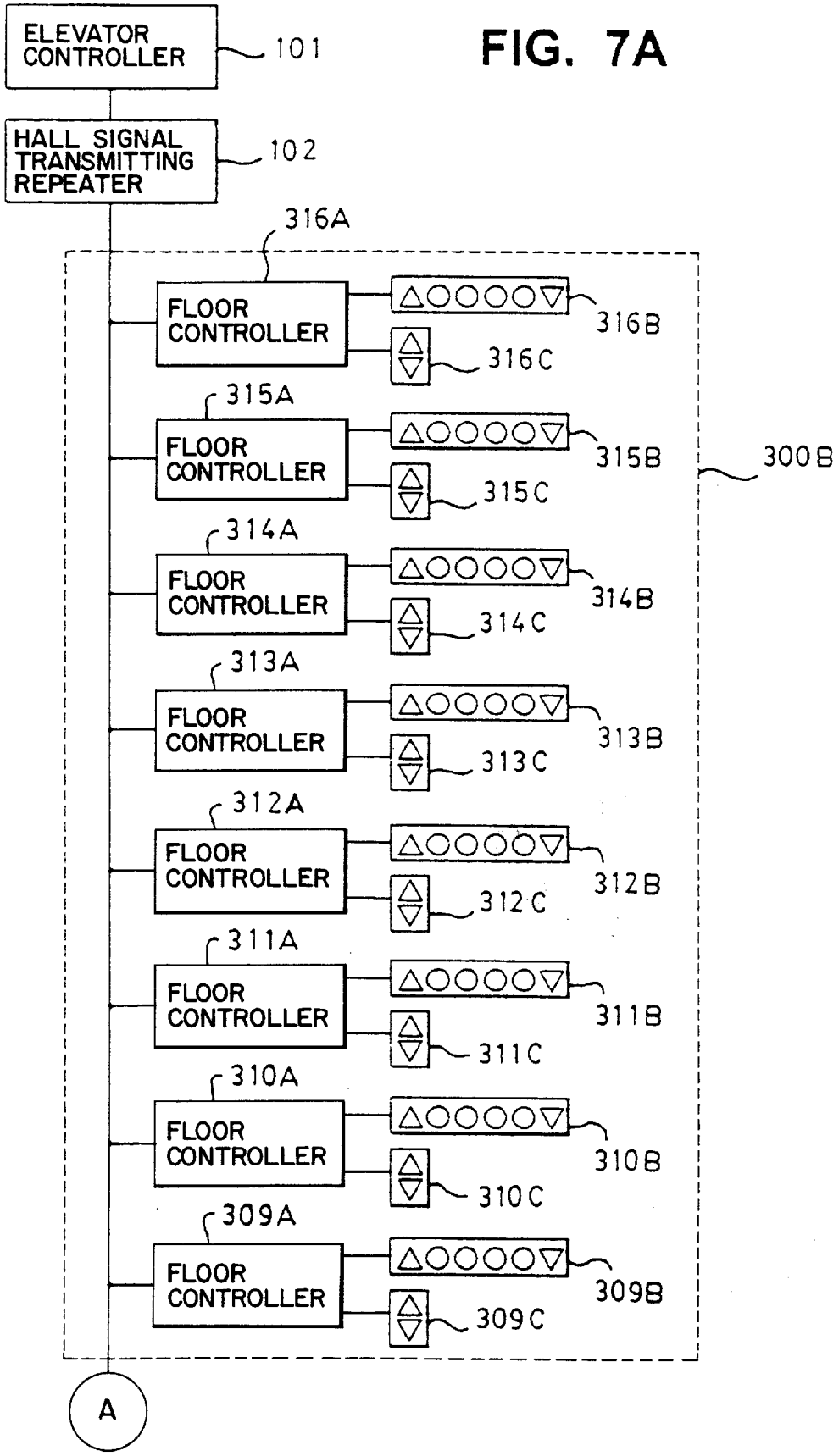
FIGS. 7A, 7B are together a block diagram of an exemplary embodiment about dividing the other group zone of the floor controller according to the invention.
Figure 7B:
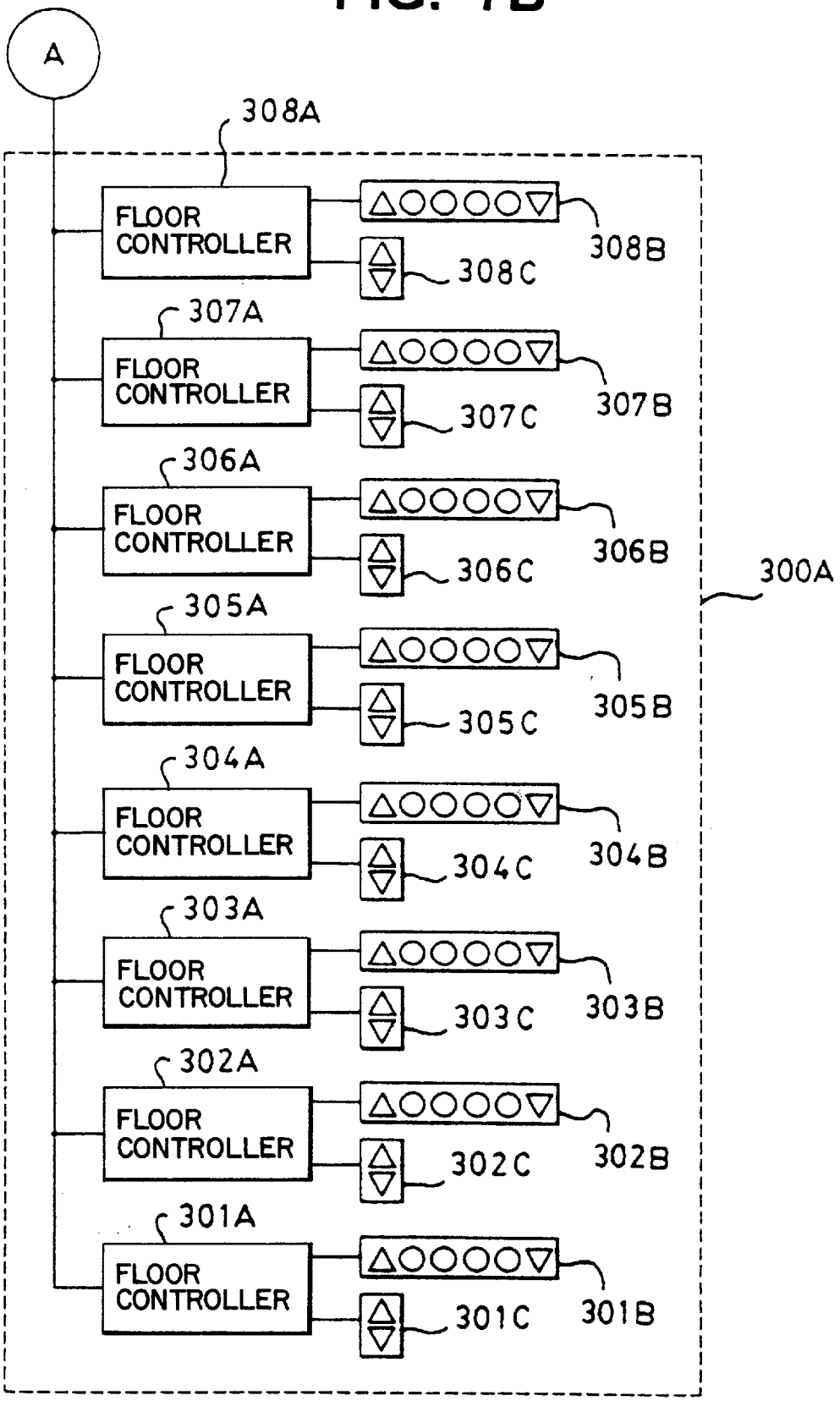

FIGS. 6A, 6B are showing that number of the floor controllers 201A–216A, the car position indicators 201B–216B, and the hall call buttons 201C–216C which are altogether set in one group 200A–200D is 4, respectively. And FIGS. 7A, 7B are showing that number of the floor controllers 301A–316A, the car position indicators 301B–316B, and the hall call buttons 301C–316C which are altogether set in groups 300A–300D of 8, respectively.

Figure 13A:
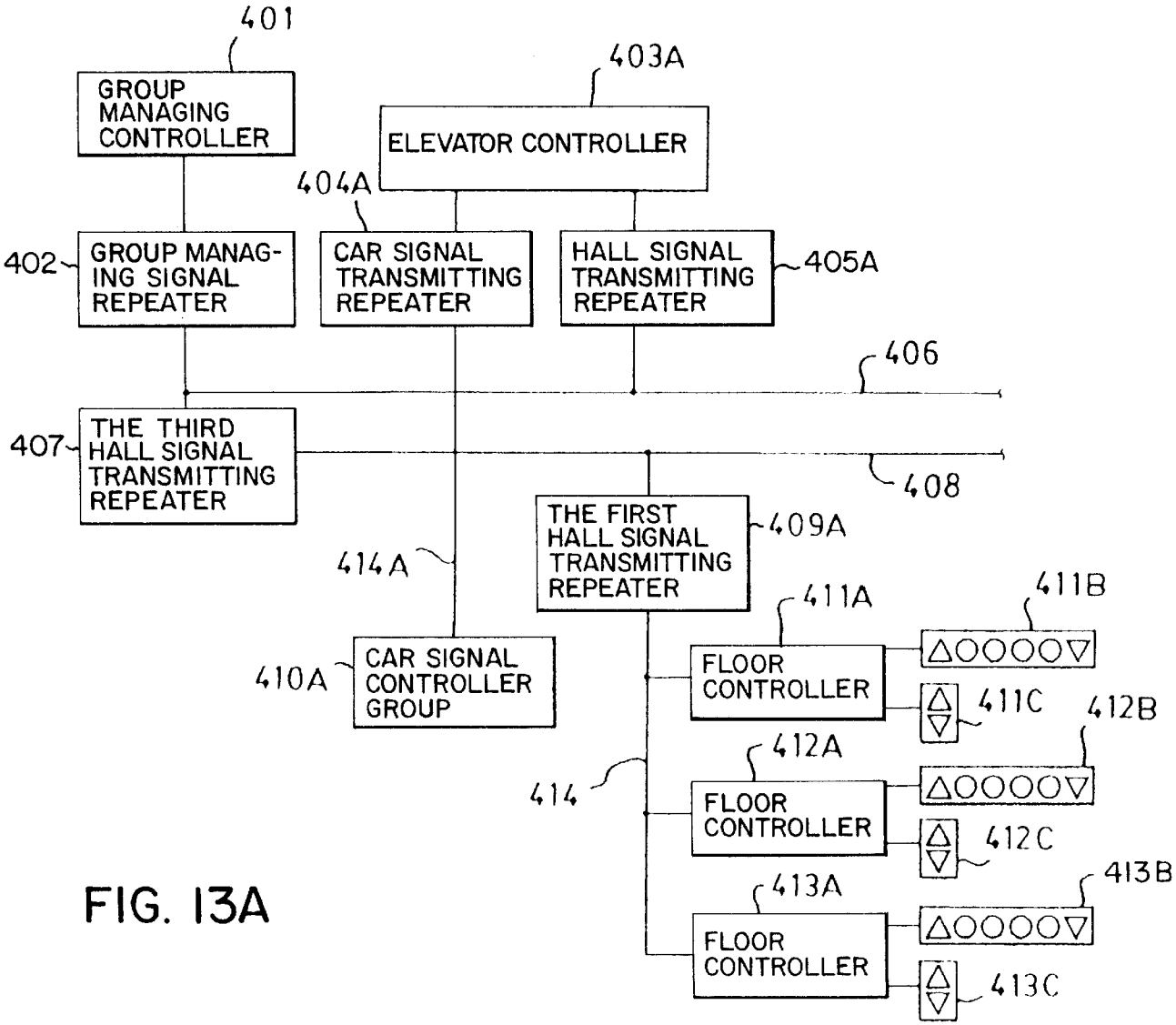
FIGS. 13A–13B are a block diagram of a group managing elevator control system according to the other embodiment according to the present invention.
Figure 13B:
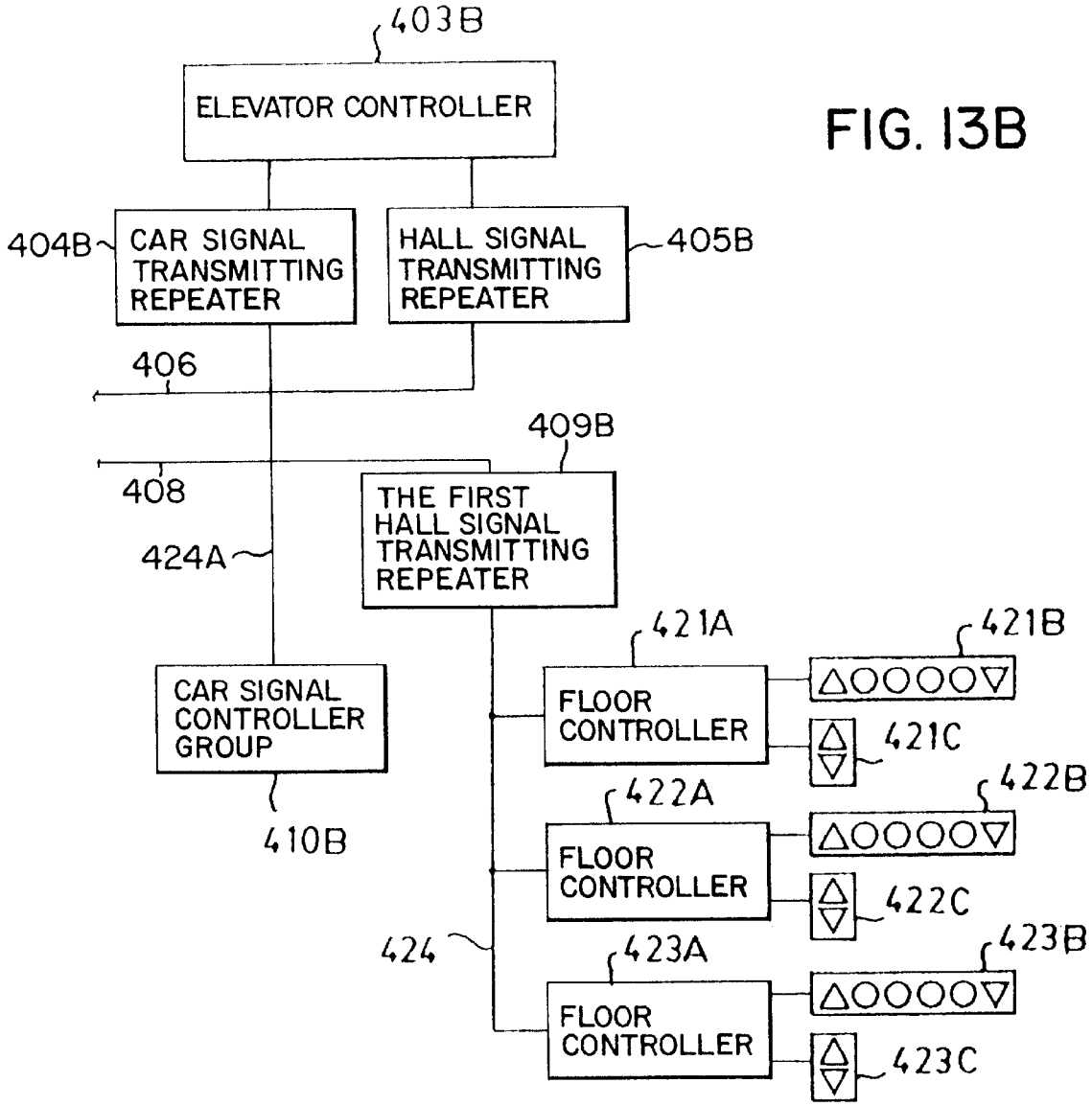

FIG. 13 shows a block diagram indicating another embodiment of the elevator control system according to the invention. The elevator control system which has a same configuration in FIG. 5 controls a pair of elevator cars which travel a plurality of floors in the building and particularly, includes a plurality of car position indicators for displaying a current floor position information of the car installed in each floor, a plurality of the first hall signal transmitting repeaters 409A, 409B for relaying an information signal from the corresponding floor controller in each car and information signal to send to the floor controller, a plurality of the second hall signal transmitting repeaters 405A, 405B for sending the information signal received from the elevator controller, sending the information signal received from the other elevator controller to the elevator controller and transmitting the information signal received from the floor controller, the plurality of the first serial transmission lines 414, 424 which the plurality of floor controllers and the hall signal transmitting repeaters are connected commonly, providing a signal transmission line between the hall signal transmitting repeaters and the plurality of floor controllers, a plurality of car signal transmitting repeaters 404A, 404B for sending an information signal received from the elevator controller to the corresponding car controller, respectively and transmitting the information signal received from the plurality of car controllers to the elevator controller, the plurality of second serial communication lines 414A, 424A being connected with the plurality of car controllers of each controller group in the plurality of cars, and providing a common signal communication line between the car signal transmitting repeater and the plurality of car controllers, a group managing controller 401 having a car assigning means for outputting an assigning signal of car to service in response to hall call signals among the plurality of cars by choosing a car according to a priority which is programmed, a group managing signal repeater 402 for transmitting the hall call signal to the group managing controller as well as for receiving and outputting the assigning signal from the group managing controller, the third hall signal transmitting repeater 407 for relaying an information signal between the group managing signal repeater and the plurality of the first hall signal transmitting repeater by connecting between them, the third serial communication line 408 for providing a common signal transmission line between the third hall signal transmitting repeater and the plurality of the first hall signal transmitting repeater, and the fourth serial communication line 406 for providing a common signal transmission line between the group managing signal repeater and the plurality of the second hall signal transmitting repeaters by being connected commonly.

The invention will be described with reference to FIGS. 4 to 19 which are added for the present invention operation.

First, the floor controllers 107A–109A are divided into the group zones 200A–200D of four units shown in FIGS. 6A, 6B when a hall signal transmitting repeater 102 transmits the signal among the floor controllers 107A–109A shown in FIG. 4, and this process is described herein.

The hall signal transmitting repeater 102 carries out a series of communicating function according to the program stored at an internal ROM. The hall signal transmitting repeater 102 puts together both a selective signal of group zones 200A–200D about the floor controllers 201A–216A received from the elevator controller 101 and the individual information, and transmits them to the floor controllers 201A–216A after receiving the selective signal and the common information at the same time. The floor controllers 201A–216A on each floor which receive the selective signal and the common signal send the information to the hall signal transmitting repeater 102, in which the common information is transmitted via a parallel input/output device, and the individual information is output selectively.

Additionally, the floor controllers 201A–216A transmit the signal repeatedly after deciding the period of time to answer by detecting the selective signal of the group zones 200A–200D, the selective signal is included in the received individual information. And the signal flowchart about the operation is illustrated by referring FIG. 9, and FIGS. 11A–11C from now.

After inputting an initial power supply, a microprocessor installed in the hall signal transmitting repeater 102 carries out an initialization setting step(step101) of various parallel input/output devices according to the predetermined order by programming, and waits(step102) for completion of the synchronization process of the elevator controller 101.

And then, the hall signal transmitting repeater 102 receives the control data and communication parameters required for communicating according to the synchronization process of the elevator controller 101, and checks the floor controllers 201A–216A during the predetermined period of time. After checking the hall signal transmitting repeater 102 sends the result to the elevator controller 101 and then goes to the next step(step103). After checking, the individual information transmitted(step104) from the floor controllers 201A–216A is transmitted from the elevator controller 101.

The operation which exchanges the information with the elevator controller 101 is accomplished successively at every predetermined period of time under the control of the elevator controller 101.

Here, the floor common information received from the elevator controller 101 is a traveling direction information, a floor character information for indicating a current car position, and an information for displaying a car driving state, such as an emergency traveling, a repairing traveling, and a car load state(for example, a lamp for indicating a full-car) altogether being an additional lighting lamp signal. And an arrival forecasting of the car, a lantern of noticing reservation, and a chime information may be included.

Figure 10A:
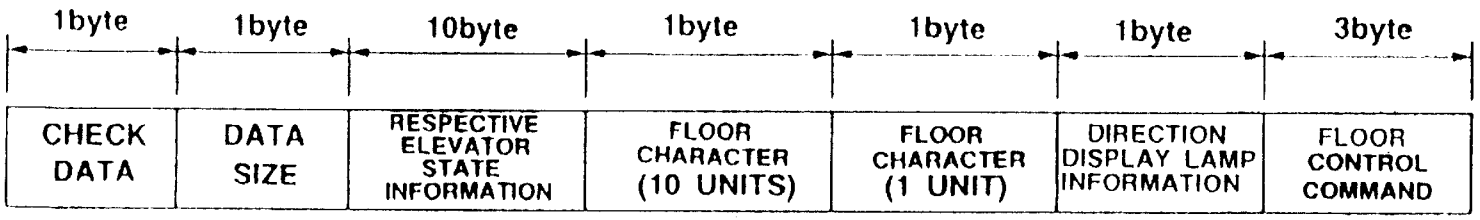
FIGS. 10A–10D are together a diagram of a data format of each signal applied to this invention.

And a corresponding elevator state information to know the state of the elevator car includes the state signal of the corresponding elevator itself whose signal is for transmitting to the other corresponding elevator, in other words, the signal of FIG. 10A when 2 more elevators carry out a parallel traveling by owning together the hall call signal.

After finishing step 104, the elevator controller 101 receives a framed check data, and the corresponding state information received from the elevator controller 101 and the floor common information are transmitted to all of the floor controllers 201A–216A, the other elevator or the group managing part (step 105–step 107).

Moreover, in case that there is an individual information (such as a call signal generated in the floor) for sending to the floor controllers 201A–216A, the individual information is mixed with the floor selecting signal of the group zones 200A–200D calculated from the floor controllers state data during the synchronization process, and then transmits the mixed information to the respective floor controllers 201A–216A. But, in case that there is no the individual information, the floor selecting signal of the group zones is transmitted during receiving(step 108–step 111).

The sending/receiving synchronization process according to the selective signal of the group zone 200A will be described.

The group zone is divided into 4 units according to a communication load capacity calculated from the plurality of floor controllers 201A–216A in FIGS. 6A, 6B. In this case, in the event of transmitting the individual information and a selective signal of the group zone 200A after the elevator controller 101 transmits the common information, all floor controllers 201A–216A send the individual information to the hall signal transmitting repeater 102 when the selective signal is assigned to a self-group zone as receiving the selective signal. The group zone is divided according to the communication load capacity, implements the communication as dividing into 8 units in FIGS. 7A, 7B.

And then the hall signal transmitting repeater 102 identifies whether or not the individual information received from the floor controllers 201A–216A is stored in an internal buffer, if so, the hall signal transmitting repeater 102 edits the individual information from each floor controller so as to transmit to the elevator controller 101 in next period of time(step 112, step 113).

Figure 11B:
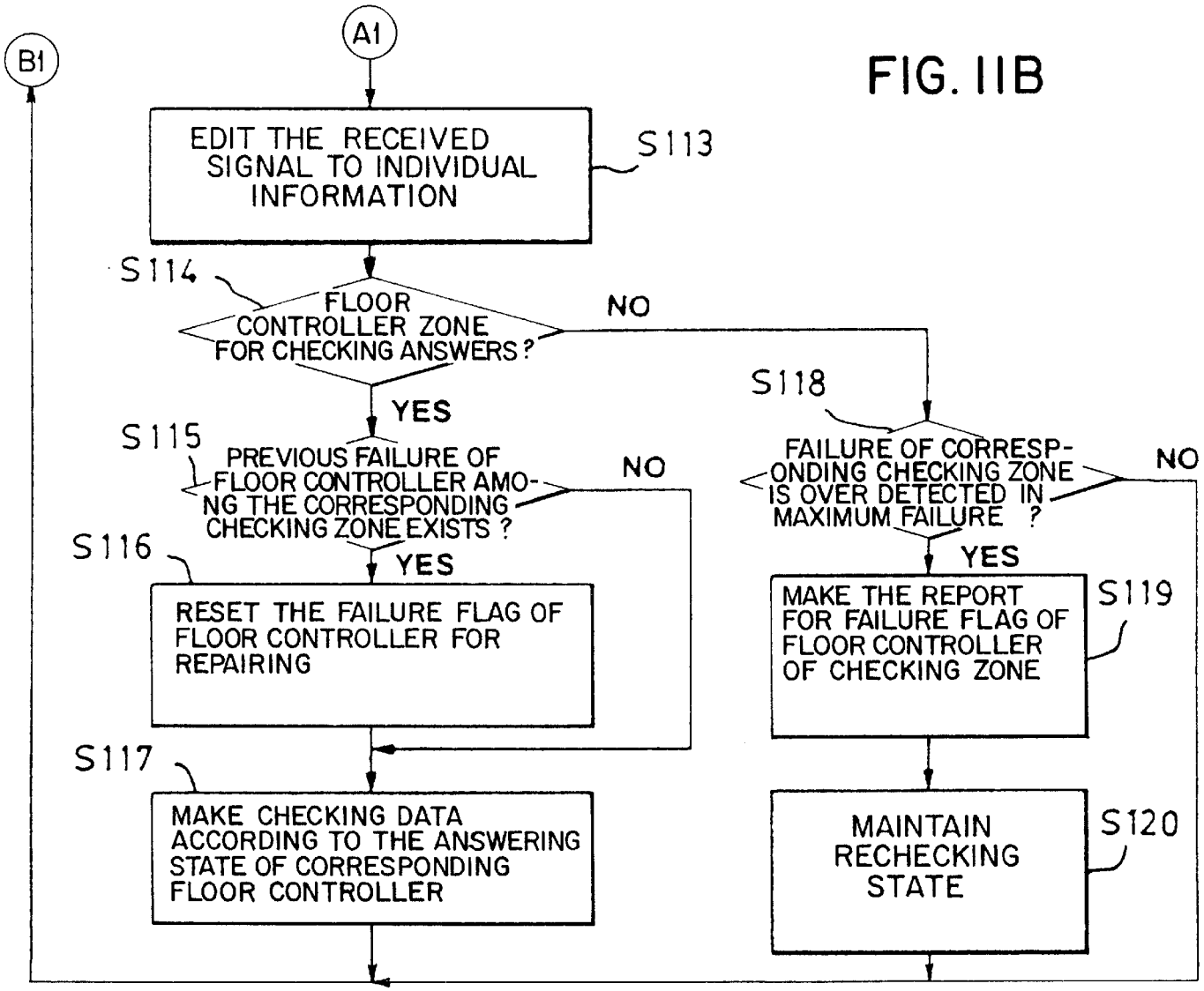
Figure 11C:
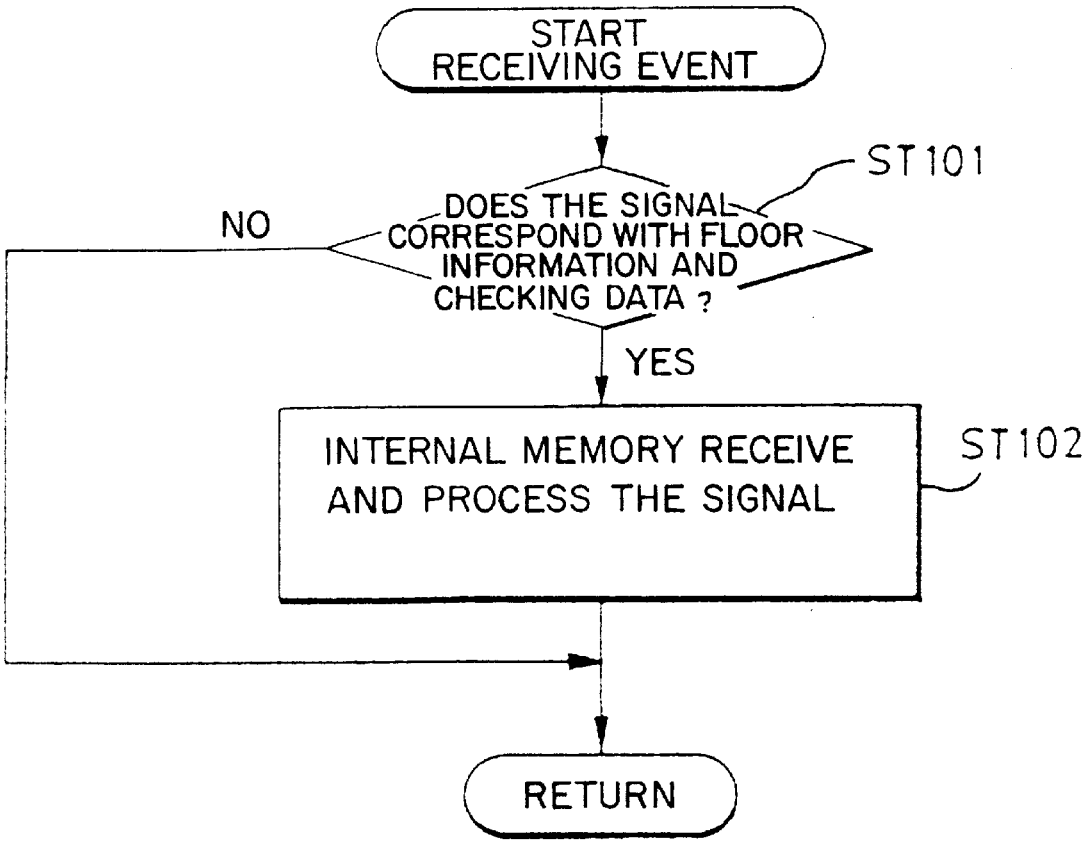

Additionally, shown in FIG. 11C the individual information which is received from each floor controllers 201A–216A generated successively is stored in the internal memory with an event format, and this process is transacted to an extra routine.

On the other hand, the floor controllers 107A–109A process the input/output signal of the floor devices installed in each floor shown in FIG. 4, in other words, the car position indicators 107B–109B, and hall call button devices 107C–109C. As illustrating the above process, the example is that the floor controllers 107A–109A are divided into the group zones 200A–200D of 4 units shown in FIGS. 6A, 6B and the signal flowchart about the process are illustrated hereinto as referring to FIGS. 12A–12C.

After performing an internal initialization step according to the program stored in the internal ROM after being supplied with an initial power supply, the floor controllers 201A–216A identify whether the floor common information received from the elevator controller 101 and the individual information exists or not. And then if it exists, floor controllers 201A–216A transmit the floor common information to the car position indicators 107B–109B via the internal parallel signal interface circuits S201–S203.

The transmitted common information indicates the format example in FIG. 10(A). An information of displaying a car position and a direction lamp information do not give the extra identifying number because the data position is predetermined.

Figure 10B:
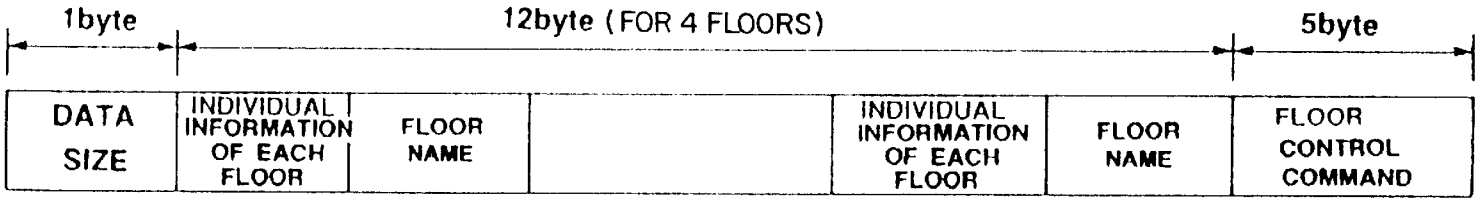

And then FIG. 10B indicates the format example about the individual information of each floor, the individual information includes the individual information about a hall call of each floor, and a floor control command which controls the hall signal transmitting repeater 102.

The floor controllers 201A–216A which receive the individual information of each floor determine whether the group zone selecting signal being in the floor control command designates the group zone of itself. If designated, the floor controllers 201A–216A decide the timing to send the identifier of itself and data. Otherwise, the floor controllers 201A–216A set a corresponding flag and predicts a busy communication line about receiving the floor checking command of the other group zones(step204–step206).

Next, the floor controllers 201A–216A compare the floor identifier(ID) being in the individual information about the hall call with the ID set in the corresponding floor controllers (step207). After being determined that they are matching to each other, the individual information(call responding signal) is transmitted to the corresponding hall call button device among the hall call button devices 201C–216C via the internal floor parallel signal interface circuit(step208). Otherwise, it goes to the step209 directly.

As identifying whether the transmission timing is up according to the previous floor command, if so, the floor controllers 201A–216A identify whether the signal from the hall call button devices 201C–216C is pushed or not (step210). After this step, in the event that there is an input signal, the floor controllers 201A–216A reset a prediction flag after transmitting the signal to the hall signal transmitting repeater 102 as coupling a side information which may be distinct for the floor controllers 210A–216A, the call button input signal(an upward or downward call), the floor individual information including the floor identifier, and an information indicating that the floor controllers 210A–216A are normal S211. However, if not, the floor controllers 210A–216A transmit the signal only to the hall signal transmitting repeater 102 in a designated transmission period of time.

Additionally, after confirming the step 209, as determining whether the allowed transmission of the individual information time is up according to the previous floor command, if not, the floor controllers 201A–216A transmit a stored signal to the hall signal transmitting repeater 102 when it approaches the predetermined information transmission period of time, after storing the signal which is inputted from the hall call button devices 201C–216C in buffer as determining whether it is the other group zone in the transmission period of time or not.

Figure 12A:
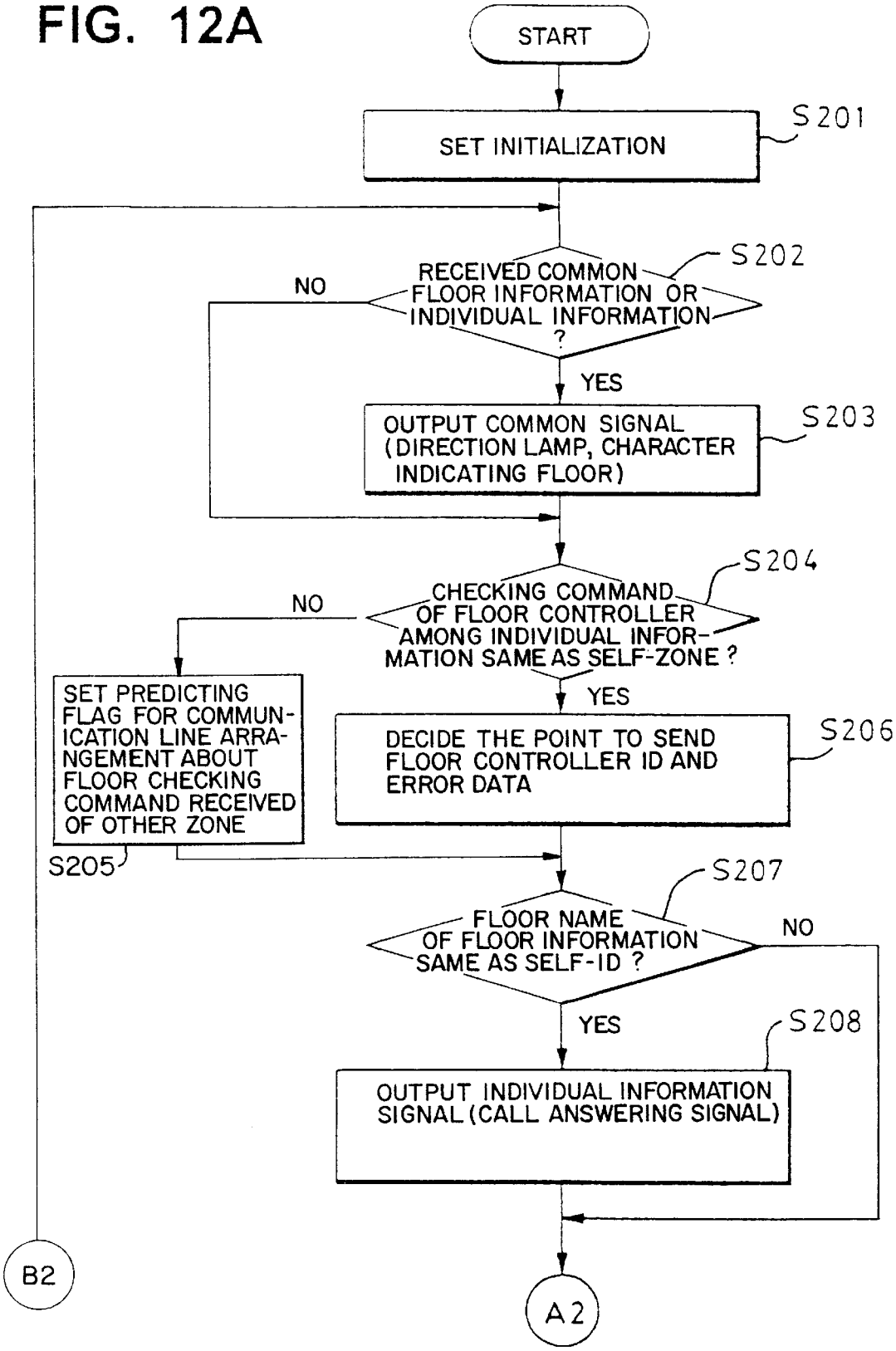
FIGS. 12A–12C are together a signal flow chart of the floor controllers according to the invention.
Figure 12B:
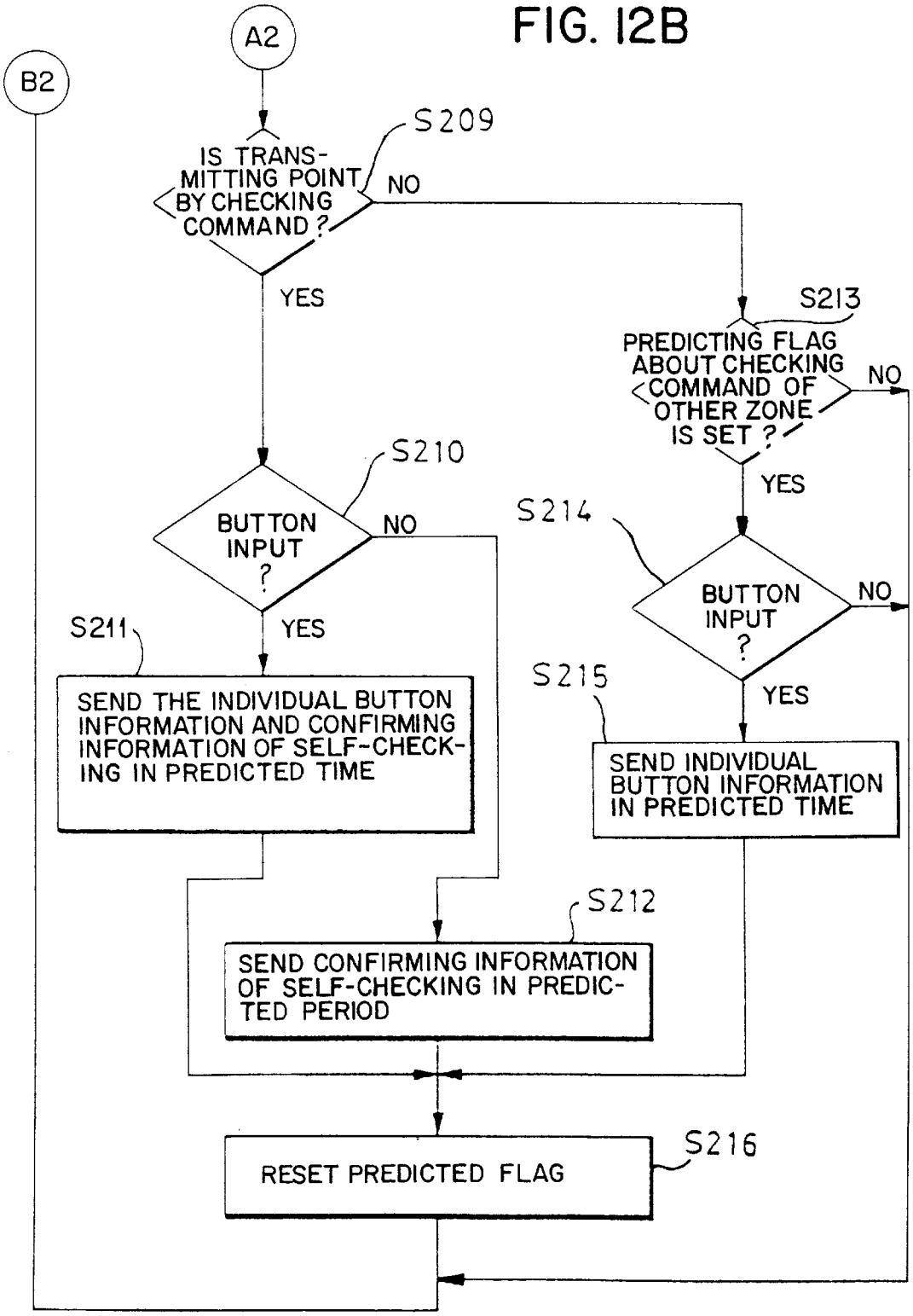
Figure 12C:
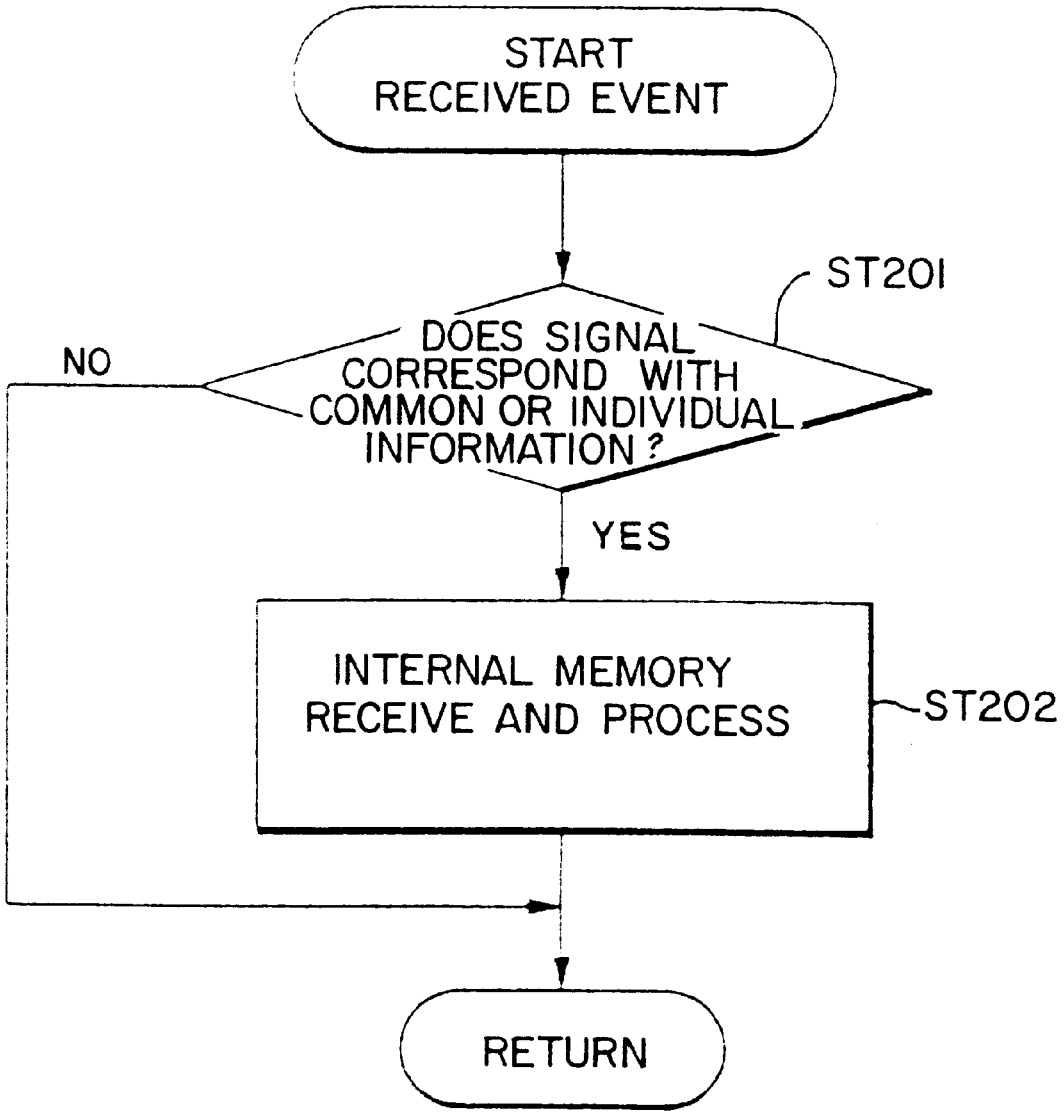

As accomplishing these series of process repeatedly, the floor controllers 201A–216A identify whether the floor common information or individual information is received from the hall signal transmitting repeater 102. If so, the floor controllers 201A–216A receive and transact the individual information by using the internal memory. FIG. 12C shows these process.

Figure 9A:
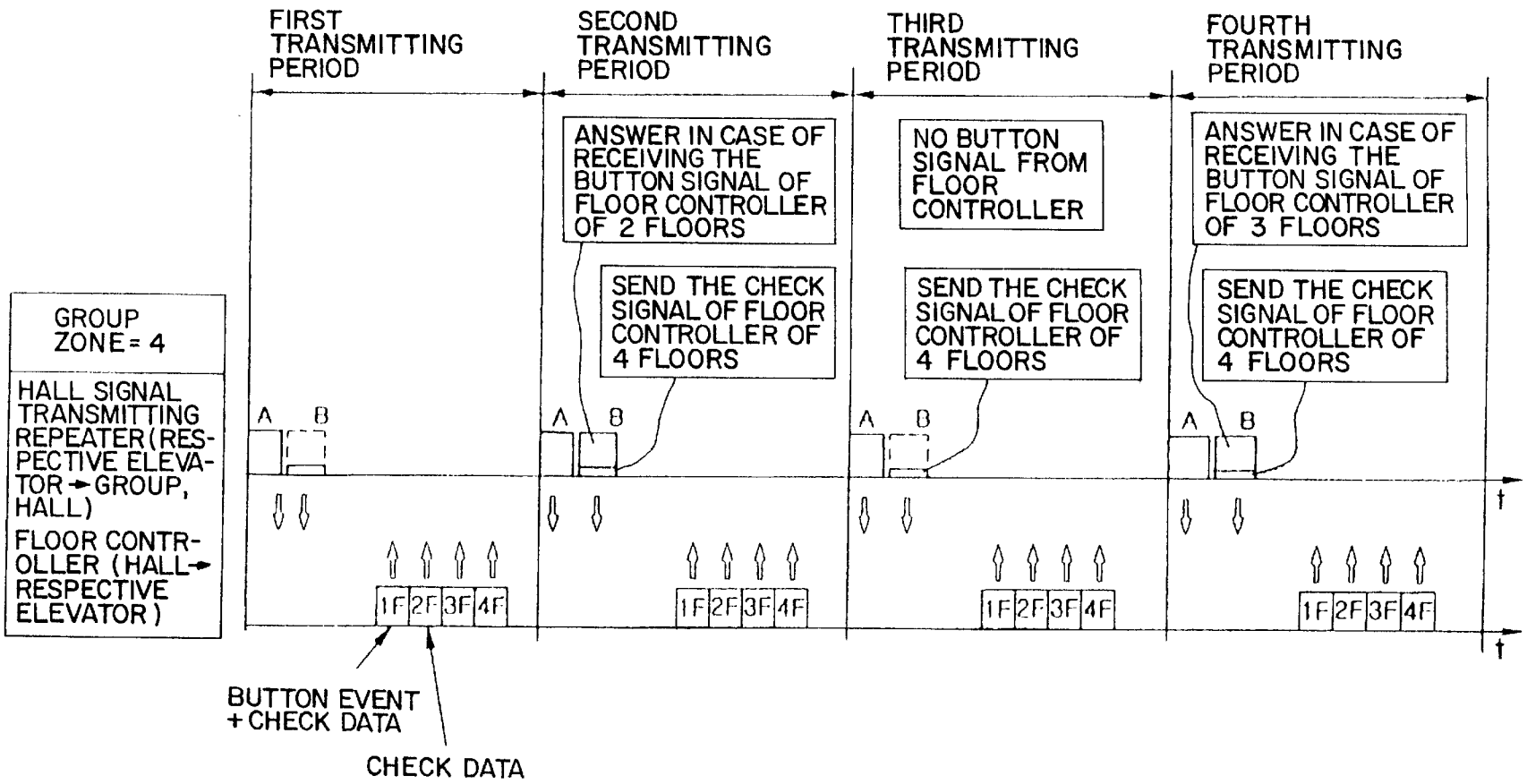
FIGS 9A and 9B are an illustration of showing the transmission method of signals in the hall according to the invention.
Figure 9B:
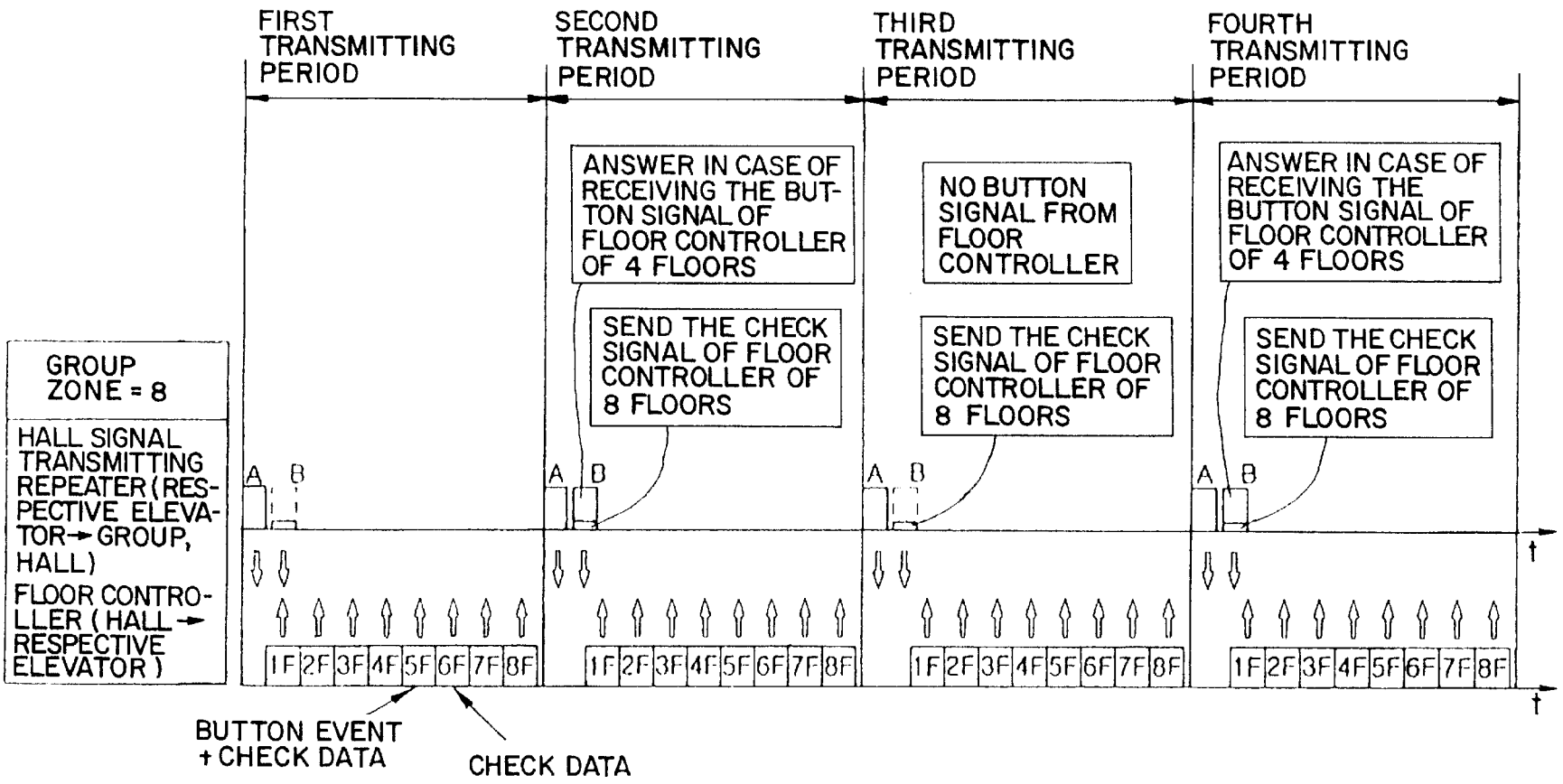

When the signal transmission is accomplished between the hall signal transmitting repeater 102 and the floor controllers 201A–216A, FIG. 9 shows the transmission type of the signal.

Like described above, the floor common information in FIG. 9 which is transmitted from the elevator controller 101 to the floor controllers 201A–216A of each floor is the same as A signal, and it is transmitted at each predetermined period of time successively as indicating a first to fourth transmission period of time. FIG. 10 shows a data format of the signals.

In FIG. 9, the A signal is set in the elevator controller 101 as an information transmitted from the other respective elevators or group management control panels, and floor controllers 201A–216A of all the floors. The other respective elevators or group management control panels received the signals recognize the number of the current valid information on the basis of the data size field, and uses the internal control transaction signal after receiving the respective elevator state information as the same number of the current valid information.

In addition, the floor controllers 201A–216A of all floors output a received information formed in a predetermined place, in other words, a common information which is a floor numeric information indicating a current floor of the elevator, and a direction lamp information to the car position indicators 201B–216B. And the floor controllers 201A–216A of all floors accomplish a hall call registration in the floor according to the floor control command, a car arrival forecasting function and so on, and carry out the control command according to the floor control command included in the floor common information indicated as A signal in FIG. 9. And the examples of the control command is a signal for checking a lighting state of hall indicators among the floor devices, that is, a chime, and a lighting indicator.

Figure 10C:
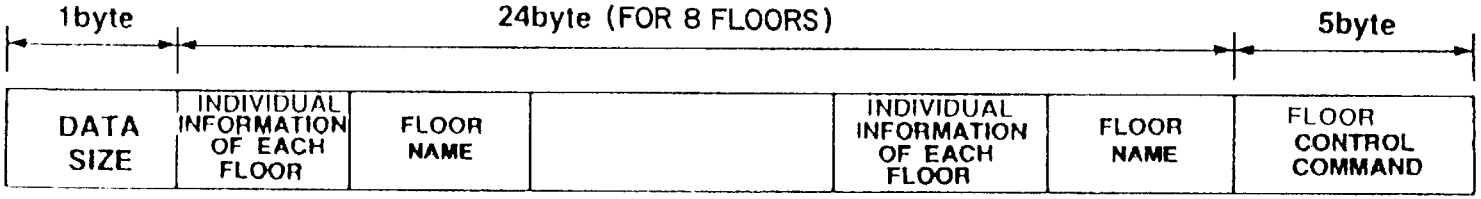
Figure 10D:
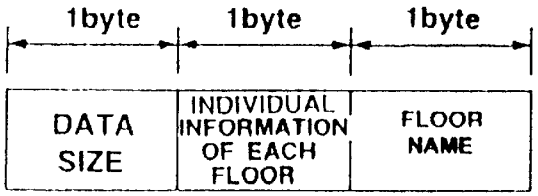

The elevator controller 101 transmits a B signal, the individual information which tells the service assignment in the floor as a format of FIGS. 10B, 10C, besides the A signal which is transmitted to the floor controllers 201A–216A of each floor in FIG. 9. And the transmission transaction will be described herein.

First, the B signal is transmitted to the all floor controllers 201A–216A to select a group zone 200A, and the floor controllers 201A–216A answer after receiving the B signal in case that the floor controllers 201A–216A are determined as a corresponding group zone.

Looking at a first transmission period of time in FIG. 9, a corresponding floor controllers 201A, 203A answer about a call request of a first floor and a third floor, the responding signal is processed in the elevator controller 101 and the processing result is included in the individual information of each floor about the first and the second floor of the B signal in a second transmission period of time in case that the group zone selecting signal included in the B signal selects and transmits the group zone 200A.

When the group zone selecting signal including the B signal selects and transmits the group zone 200B, the floor controllers 201A–216A received the signal floor ID. The floor controllers 201A–216A of the first floor and the third floor operate the hall call devices, in other words, the car position indicator and the hall call button devices 201B, 201C and 203B, 203C. And the floor controllers 205A–208A included in the group zone 200B transmit both a button input signal and a checking signal to the elevator controller 101 via the hall signal transmitting repeater 102, include a process result of the signals with the individual information about 5th-8th floors of B signal in the third transmission period of time.

When the group zone selecting signal selects a group zone 200C, the selecting signal is transmitted to the floor controllers 201A–216A by including the selective signal in floor control command of the individual information, the floor controllers 201A–216A received the signal identifying the individual ID. The floor controllers 205A–208A of the 5th floor through the 8th floor operate floor call button devices 205C–208C. And the floor controllers 209A–212A included in the group zone 200C transmit a button input signal and a checking signal to the hall signal transmitting repeater 102.

In a 4th transmission period of time, it returns again to the first transmission period of time after transmitting the signals successively such as a timing figure of FIG. 9.

Because the plurality of floor controllers are sorted to any group according to a communication load capacity, and a transmission time is decided according to the floor controllers in the group, the sending/receiving of the common information and the individual information between the elevator controller 101 and the plurality of floor controllers 201A–216A are efficiently accomplished. And in case that an efficient signal transmission can be accomplished in an actual elevator usage environment, when any information needed among the devices besides a control information every time is sent/received, a fast answering and a quick error detection are guaranteed. Also, because an extension of extra devices become easier, the signal may be transmitted nevertheless in a skyscraper, and an express elevator.

In another embodiment, a signal transmission method between the elevator controller 101 and the car controllers 110A, 111A of the car controller group 106 shown in FIG. 4 will be described herein. There may be at least one car traveling operating panel. In other words, the traveling operating panel of the maximum 4 should be installed in the car because operating panel may be separated and installed the traveling operating panel for a general use, for handicapped, and may be divided into a main operating panel and a secondary operating panel, respectively.

Additionally, the car controllers 110A, 111A are independently composed to control input/output signals which are a button signal of a respective operating panel, a switch signal, and a lamp signal of various display devices because the number of the lines are increased in case that several traveling operating panels are installed like above illustrated. And since the respective traveling operating panel is connected to the power supply lines and the communication lines only for operating the car controllers 110A, 111A, the number of the installed lines are decreased sharply.

Figure 15A:
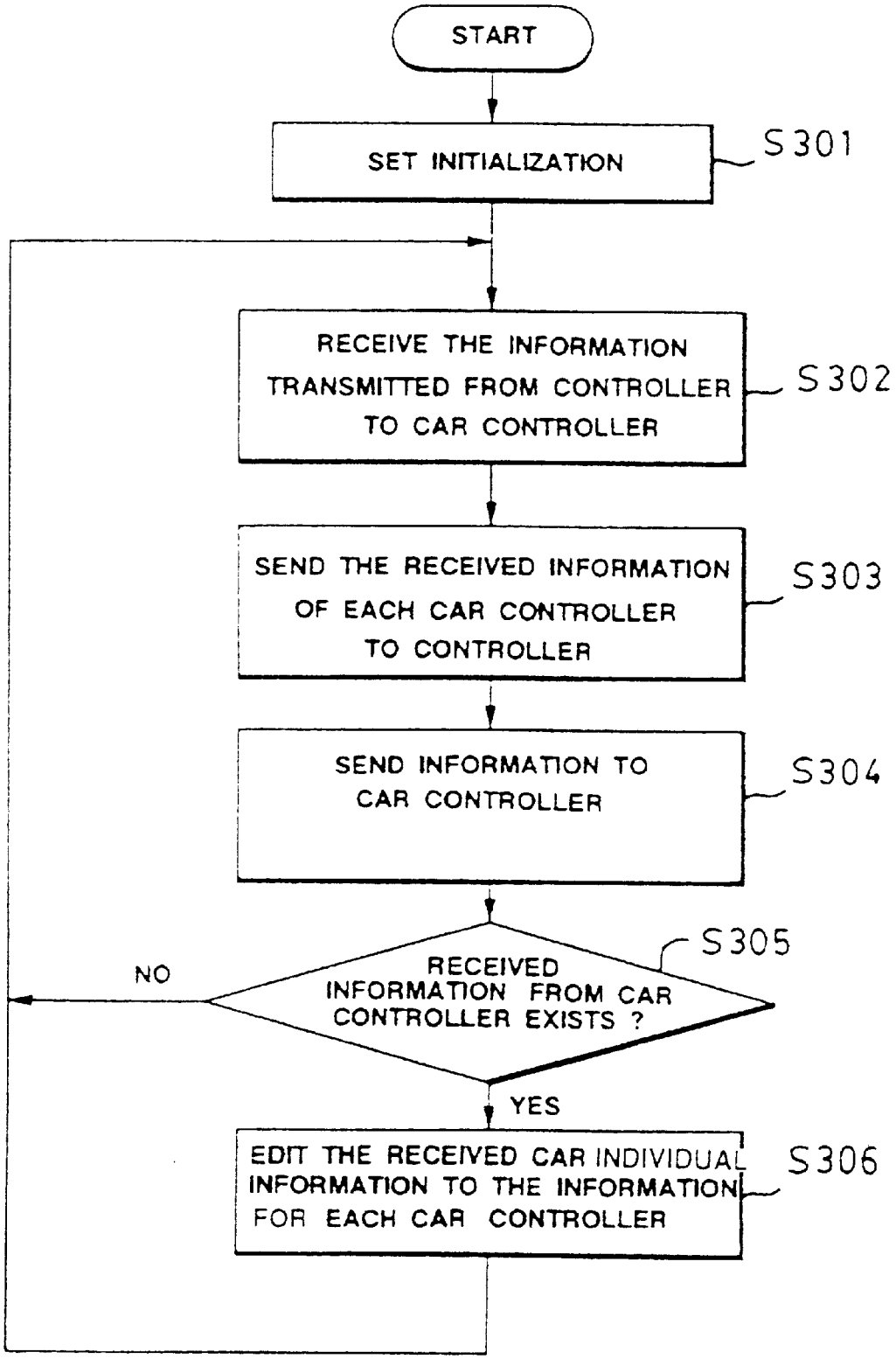
FIGS. 15A, 15B are together a signal flowchart of the car signal transmitting repeater according to the invention.
Figure 15B:
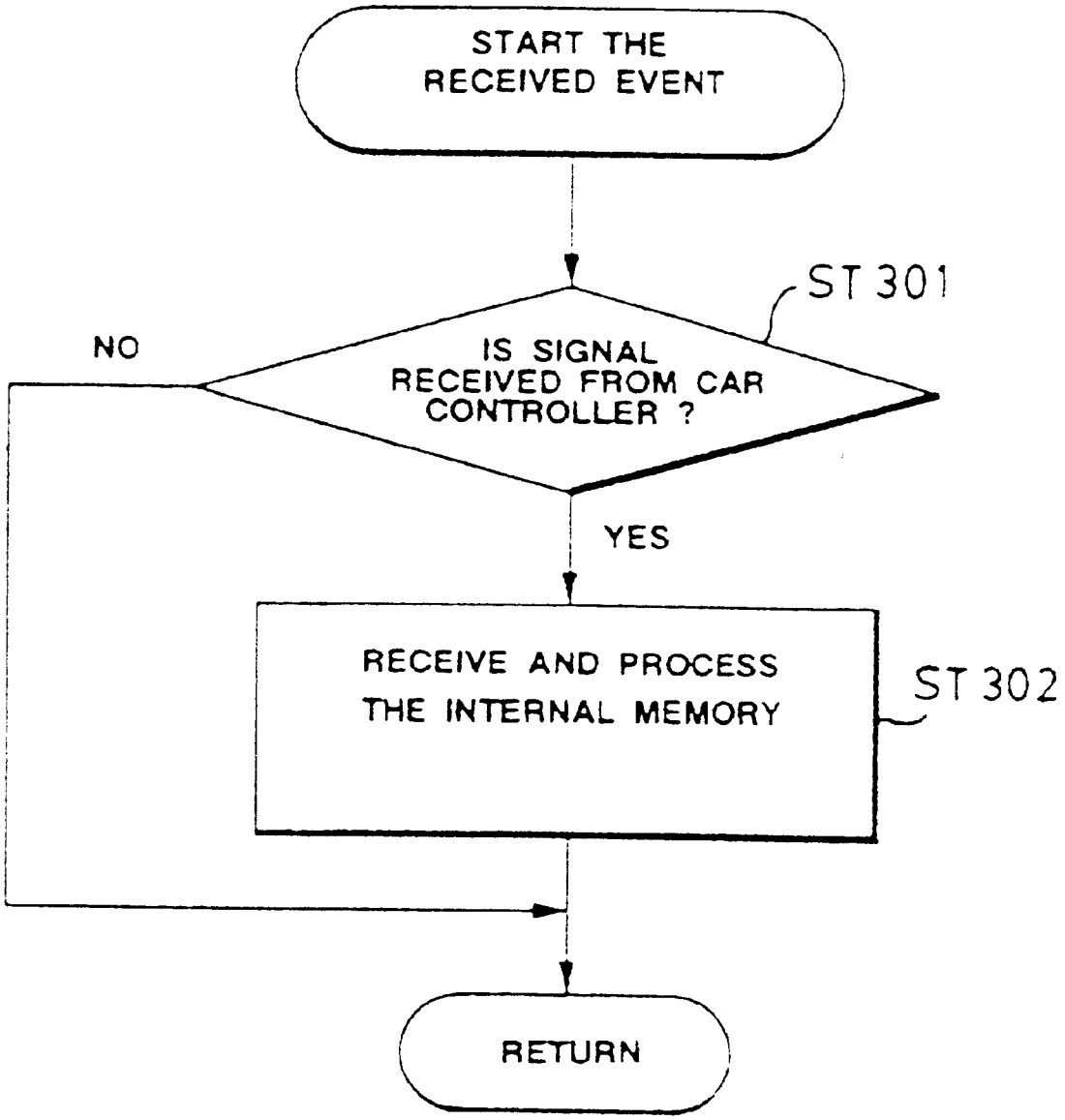

FIGS. 15A, 15B illustrate signal flows according to the operation of the car signal transmitting repeater 103 which relays the signal transmission between the elevator controller 101 and the car controllers 110A, 111A, having the signal transmission devices.

After inputting an initial power supply, the microprocessor mounted on the car signal transmitting repeater 103 accomplishes an initialization process step according to the program stored in ROM, receives the signal transmitted from the elevator controller 101 to the car controllers 110A, 111A, and transmits the received information of car controllers 110A, 111A to the elevator controller 101 (step301–step303).

Generally, an information of a transmission period of time received from between the elevator controller 101 and the car controller 110A is periodically accomplished by the elevator controller 101 at every predetermined period of time, the received information is transmitted to the car controllers 110A, 111A commonly as a D signal shown in FIG. 14C.

A transmission type of the D signal which is the same as FIG. 14C, always changes the signal value at every period of time for a specified period of time successively (for example, increase 1 successively from 11 to FF) in a check data field and so detects a validity of signal which is the transmission period of time from the car controllers 110A, 111A to the elevator controller 101. And the transmission type of the D signal writes a number of a valid data of field in a data size field, and transmits a type of an ID of each signal type after adding a control data in an actual controlled data, in which the ID determines the type of a data.

By giving a number which is from 0 to 255 with the type of the ID, it is classified as a kind of overall 256, and is flexible about the signal variation and addition according to this, an example of giving the ID is described herein;

No. 0–10: a signal of lighting lamp for a destination floor call registration of a traveling operating panel for a general use.

No. 11–20: a signal of lighting lamp for a destination floor call registration of a traveling operating panel for a handicapped.

No. 21–30: a signal for lighting lamp for displaying a driving state of a traveling operating panel.(a direction lamp, a displaying lamp for being checking, a full-car display lamp).

No. 31–40: a control command of the car controllers (checking an indicator, a chime checking, a buzzer checking command, and so on).

No. 50–70: character information for displaying a car position.

No. 71–80: character information transmitted as VMD (Visual Message Display).

Accordingly, the ID and the data content are commonly transmitted to the car controllers 110A, 111A coupled in a common transmission line 104 at the same time, in which the ID can recognize the type of the signals according to a generated signal of each period of time, and the car controllers 110A, 111 A output to outer devices by inputting an ID data only in accordance with the predetermined individual ID according to the individual ID given of each traveling operating panel which is one or a plurality, after receiving the signals.

After identifying whether there is an information received from the car controllers 110A, 111A(step305), if so, the received information is edited to data type for transmitting the individual information according to the car controllers 110A, 111A to the elevator controller 101(step306) and a series of process(step302–step306) is accomplished repeatedly like above-described.

Besides a series of process(step302–step306) above, after identifying an event which receives the signal from the car controllers 110A, 111A(ST301), if so, the received information is stored in the internal memory(ST302).

Figure 16A:
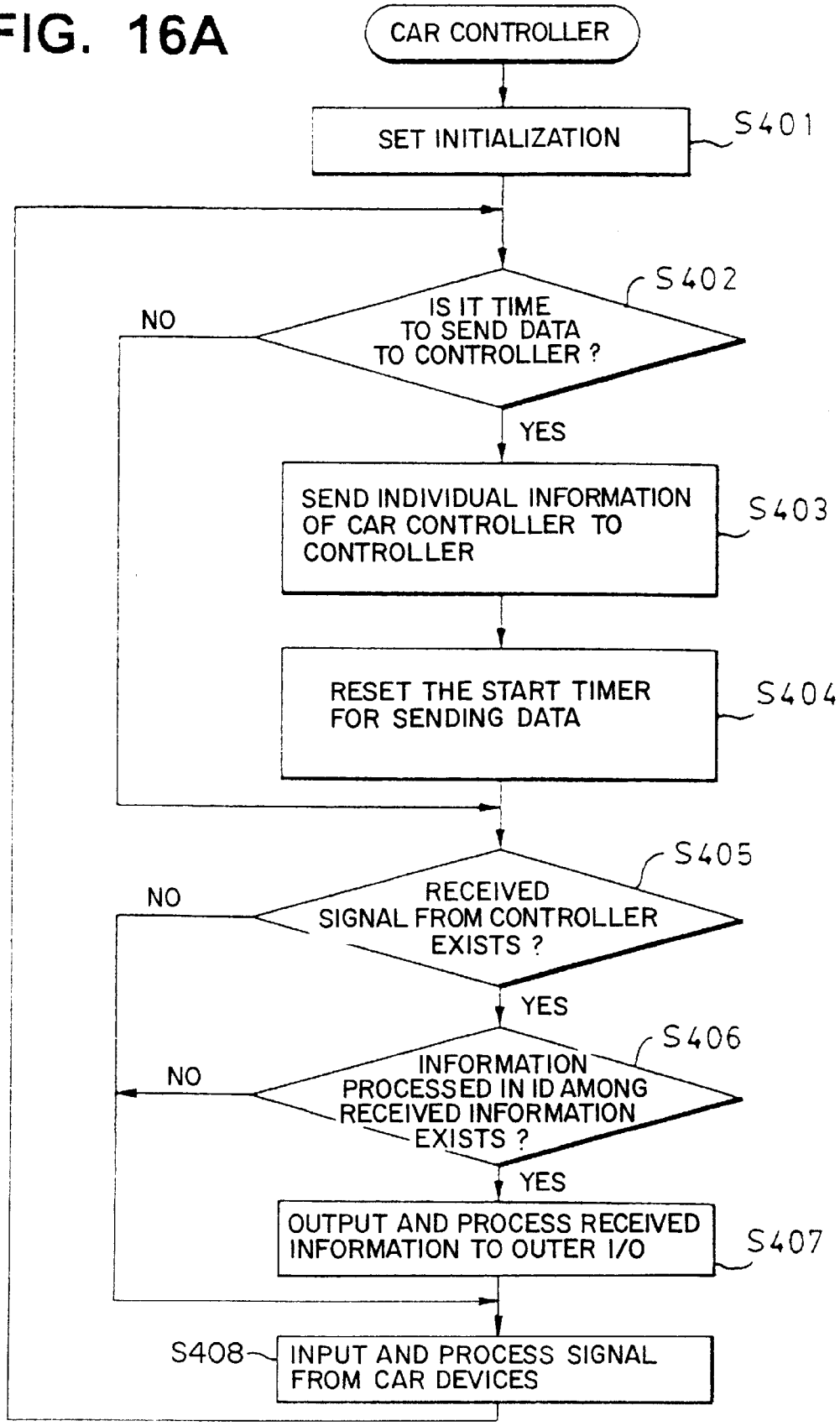
FIGS. 16A, 16B are together a signal flowchart of the car controller according to the invention.
Figure 16B:
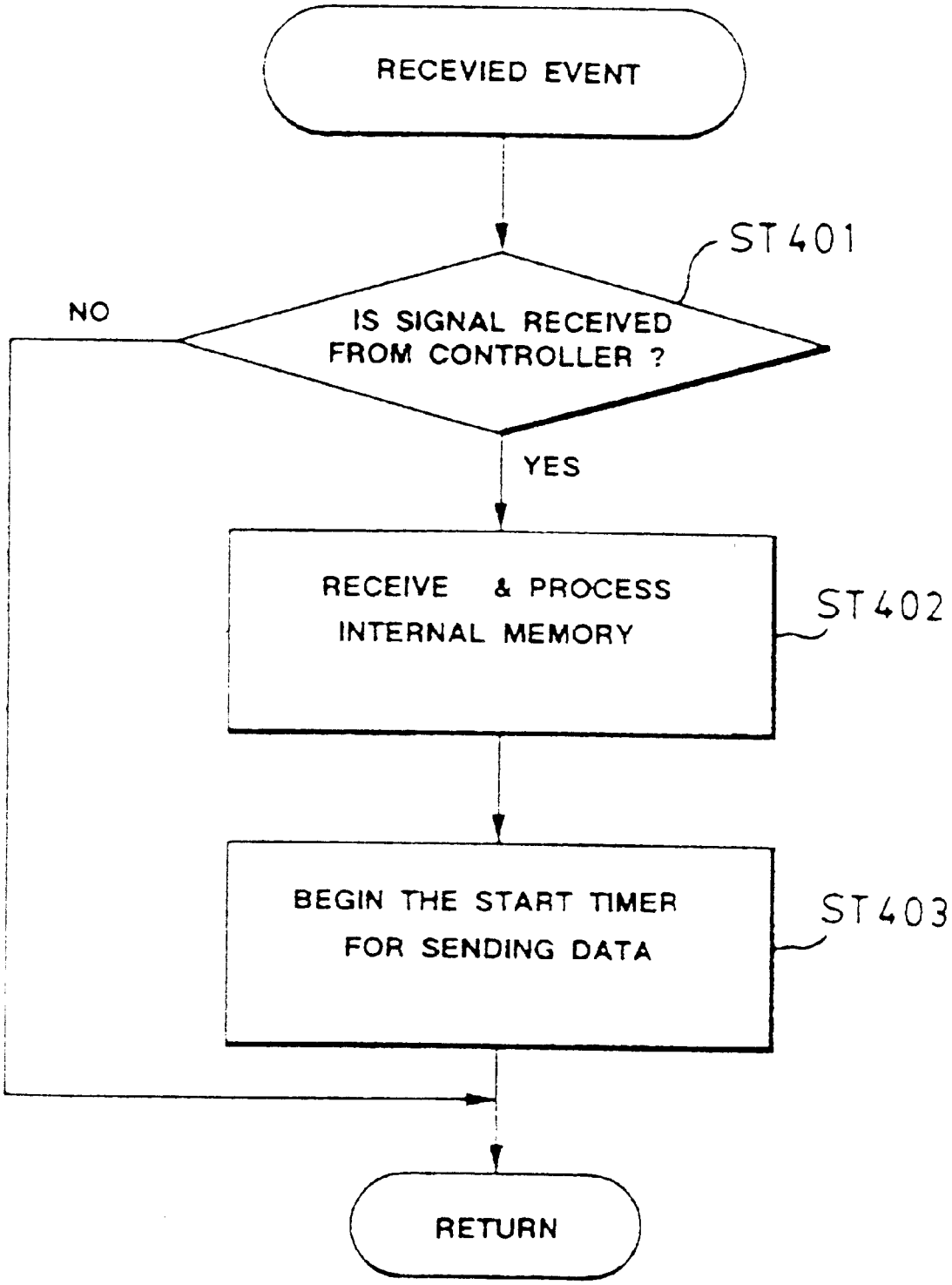

On the other hand, a signal flow about the transacting of the car controllers 110A, 111A will be illustrated by referring FIGS. 16A, 16B.

In case of inputting an initial power supply, the car controllers 110A, 111A accomplish the initialization process according to the program stored in an internal ROM, and identify whether it is a period of time to transmit the signal to the elevator controller 101. The car controllers 110A, 111A transmit the signal inputted from the car traveling operating panels 110C, 111C and from the same car devices in case that it is time to transmit, and reset the data transmission start timer for next transmission (step401–step404).

Then the car controllers 110A, 111A identify whether there is a signal received from the elevator controller 101, if so, identify whether there is an ID which is processed from an individual ID among the received information. After identifying, in case that the ID exists, the car controllers 110A, 111A output the corresponding received information to a car outer device(step405–step407).

The output signals are a traveling direction lamp information, a car position display information, an information for displaying the driving state(for example, a checking lamp, an indicating full lamp, and an emergency driving lamp), and a lamp control signal for a destination floor call registration of a traveling operating panel.

The received information from car devices is edited to a data type for transmitting the signal to the elevator controller 101(step408) and a series of process is accomplished repeatedly like above-described(step402–step408).

Besides a series of process(step402–step408) above, after identifying an event which receives the signals from the elevator controller 101(ST401), if so, the received information is stored in the internal memory(ST402), and the signals drive the data transmission start timer which decides the time for transmitting itself(ST403).

Sending/receiving timing relation between the car signal transmitting repeater 103 and the car controllers 110A, 111A will be described by referring FIG. 14.

An individual information and a common information which are transmitted from the car signal transmitting repeater 103 to the respective car controllers 110A, 111A are sorted to a format of each signal type, and the sorted signals are set to the ID which can be processed by the respective car controllers 110A, 111A by being given a series of numbers of each signal type.

Accordingly, the car controllers 110A, 111A identify whether the corresponding ID of a signal type is or not after receiving the signal transmitted periodically from the elevator controller 101, input and process the corresponding signal only. So the signal transmitted from the elevator controller 101 periodically is accomplished by always being mixed with the individual information of each car controller and a common information. Since this process is accomplished, it is possible to transmit the signal by only 1 transmission transaction, so a transmission period of time is applied efficiently.

When the car controllers 110A, 111A transmit the signals received from the car devices after receiving the information from the elevator controller 101, the car controllers 110A, 111A set an operating time of a data transmission start timer of each ID set in the car controllers 110A, 111A, and transmit at the timing of the timer operation, separately.

In other words, shown in FIG. 14B the signals transmitted from the car controllers 110A, 111A to the elevator controller 101 are transmitted in an order of 1C, 2C, 3C, and 4C having the time difference evenly. Therefore, several car controllers transmit the signals separately via the common transmission line 104, also a probability generating the data collision on the common transmission line is decreased, it is to improve a reliability of the communication consequently.

In addition, because the signals of respective devices are already sorted with the ID of each signal type in order to recognize the signal type of each respective control device of the 1C, 2C, 3C, and 4C, it is not difficult to determine whether the signal transmitted to the elevator controller 101 is transmitted from which one of the car controllers.

And a validity of the sending/receiving signal between the elevator controller 101 and the car controllers 110A, 111A at every period of time is ensured, by transmitting conversely a check data content transmitted from the elevator controller 101 in transmission period of time on a check data field. A reliability of sending/receiving signal is guaranteed, and may protect the data damage by an outer noise, by retransmitting data received at previous period of time when a damage has occurred on the check data in the next period of time.

Consequently, using the above described the signal transmission methods, signals may be transmitted nevertheless in a skyscraper, an express elevator without particular restraint, a fast answering and a quick error detection are guaranteed, and a proper answer is expected in a desired period of time when any information needed among the devices at every period of time is sent/received. A reliability of sending/receiving signal is guaranteed as well.

For example, an information byte number of a signal data format of each port in FIG. 4 is a data number set by supposing a case that a probability which a call may be simultaneously generated from a floor in the period of time is 4 floors, when the data is sent/received using 80 ms period of time between the elevator controller 101 and the respective floor controllers 107A–109A. Therefore, a modification about the information byte number may alter without any limitation according to the building's situation, and character.

Figure 17:
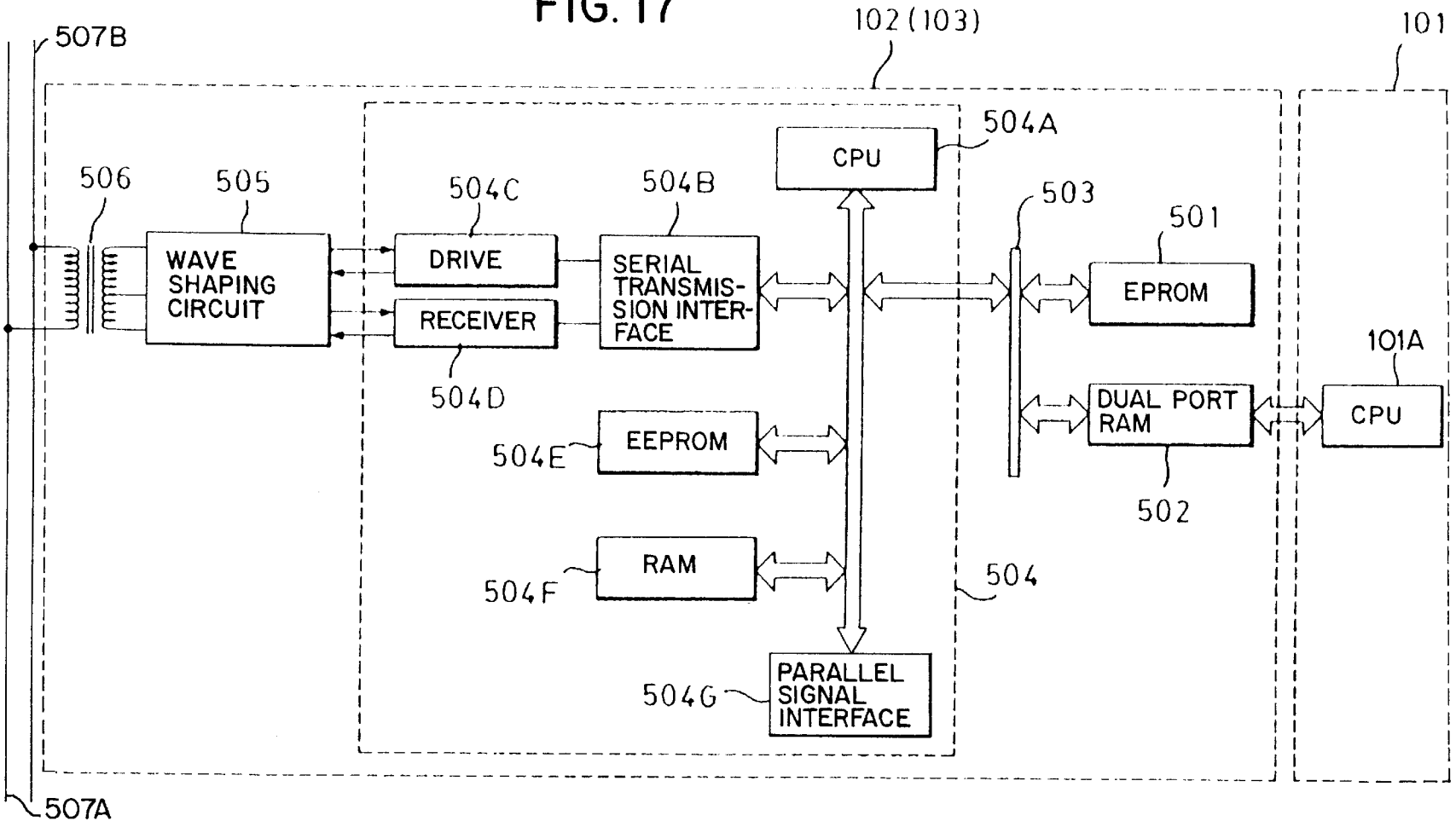
FIG. 17 is a detailed block diagram of the hall signal transmitting repeater and the car signal transmitting repeater according to the invention.
Figure 18:
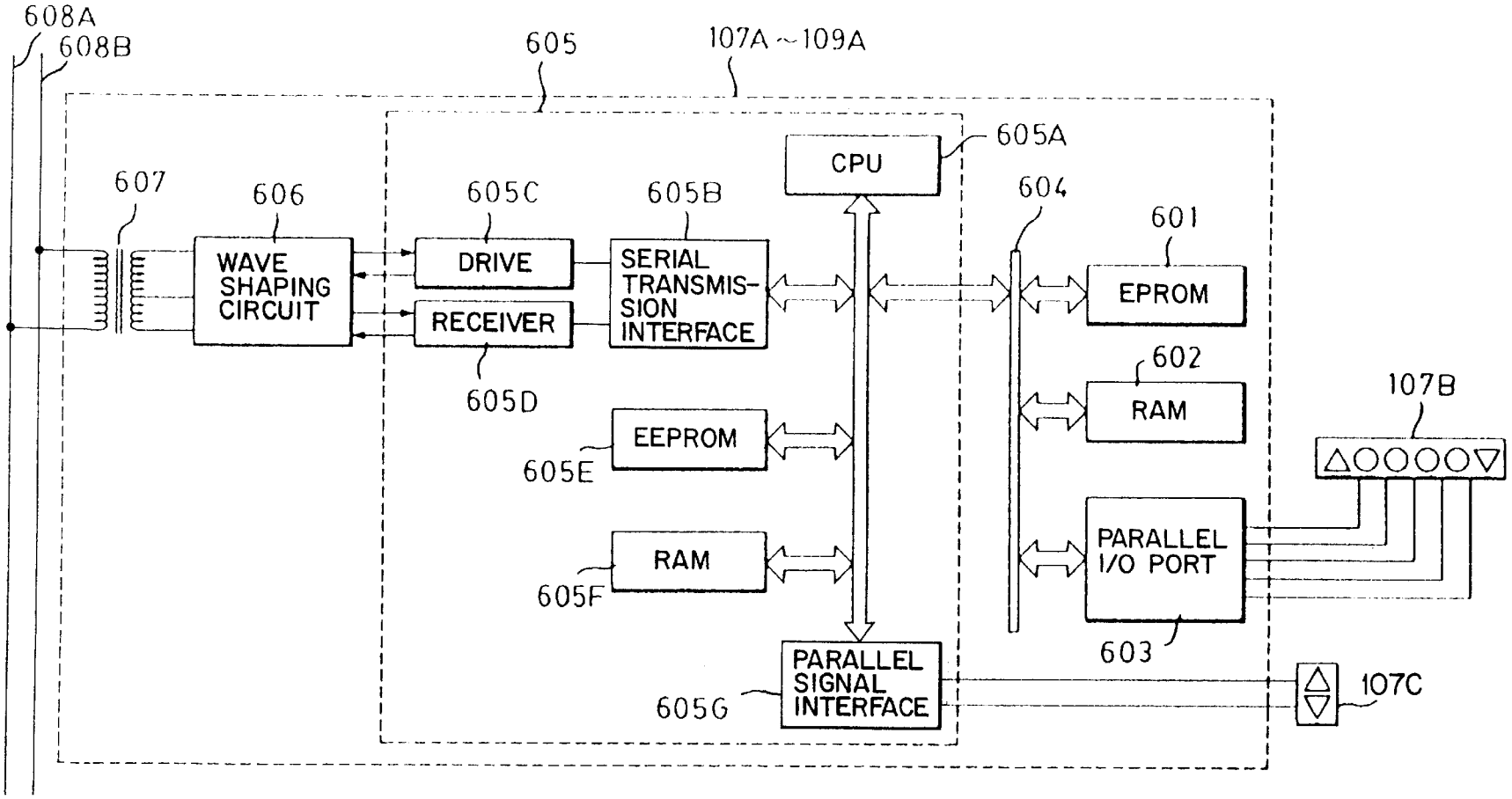
FIG. 18 is a detailed block diagram of the floor controllers according to the invention; and, FIG. 19 is a detailed block diagram of the car controller according to the invention.
Figure 19:
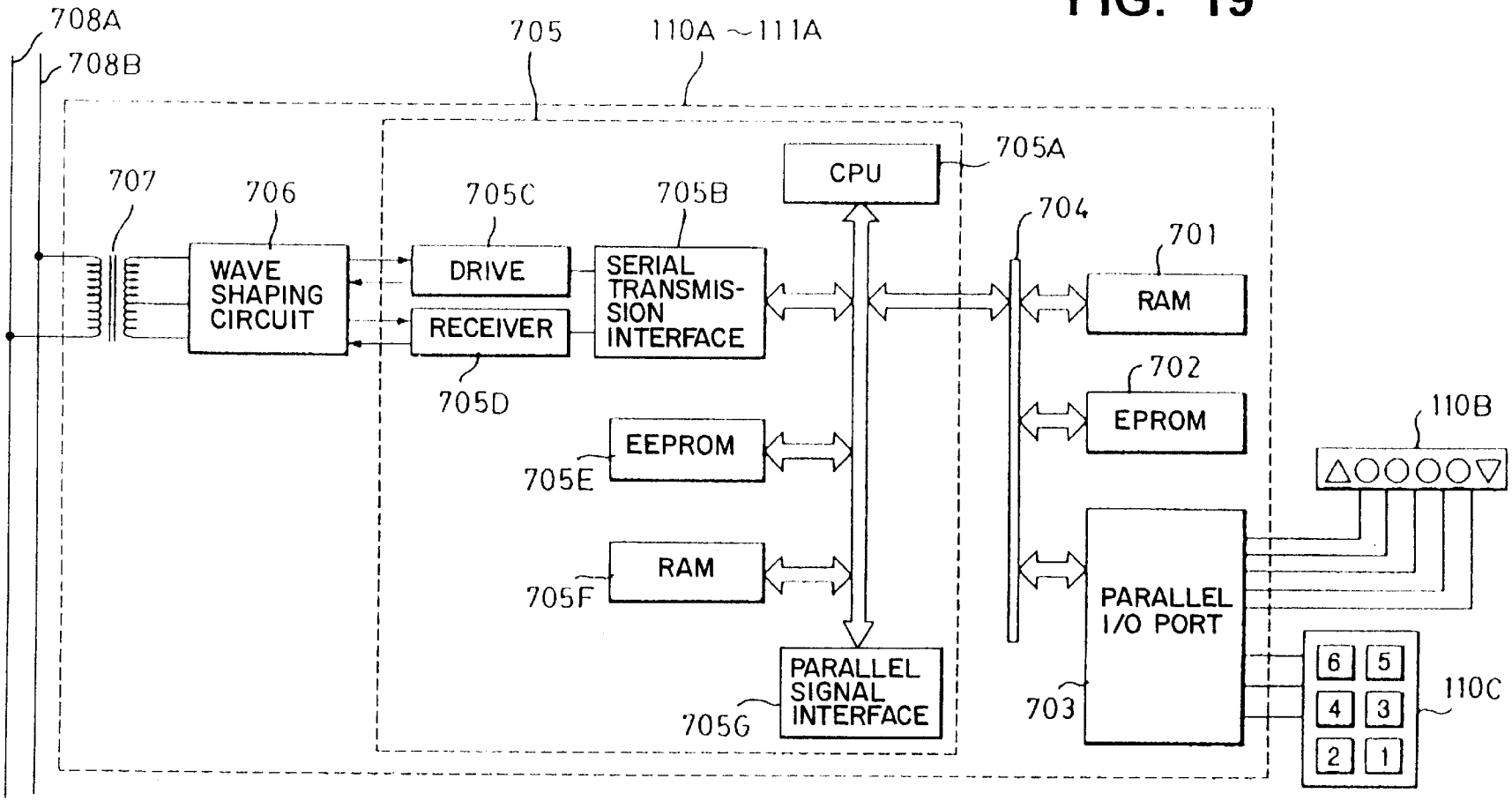

On the other hand, the transaction of the car signal transmitting repeater 103 or the hall signal transmitting repeater 102, the floor controllers 107A, 109A, and the car controllers 110A, 111A are further illustrated by referring FIGS. 17–19.

First, similar to the process in FIG. 17, the hall signal transmitting repeater 102 or the car signal transmitting repeater 103 has an one-chip micro-computer 504 which is comprised of devices of an EEPROM 504E storing an information for a serial signal transmission, a RAM 504F for an operating space which is needed for working program, a serial transmission interface 504B, a drive 504C and a receiver 504D for sending/receiving a serial signal, a parallel signal interface 504G for parallel interfaces with outer devices and a CPU 504A, and the micro-computer 504 has a configuration connected with outer EPROM 501 having an application program via a bus 503. And the micro-computer 504 may send/receive the signal by connecting with a CPU 101A of the elevator controller 101 via a dual-port RAM 502, and send/receive with the devices in the floor or the car devices by connecting with the common transmission lines 507A, 507B via a wave shaping circuit 505 and a pulse transformer 506.

Accordingly, a button answering signal and a driving state signal received from the elevator controller 101 is successively output via a serial transmission interface 504B and a drive 504C in the micro-computer 504, is successively transmitted to each floor controller or the car controllers via the wave shaping circuit 505, and the pulse transformer 506.

Additionally, the call button signal and the switch input signal transmitted from the floor controllers 107A–109A or the car controllers 110A, 111A are transmitted to the CPU 101A of the elevator controller through the routine.

On the other hand, in FIG. 18, the floor controllers 107A–109A have an one-chip micro-computer 605 which is comprised of devices of an EEPROM 605E stored an information for a serial signal transmission, a RAM 605F for an operating space which is needed for program working, a serial transmission interface 605B, a drive 605C and a receiver 605D for sending/receiving a serial signal, and a parallel signal interface 605G for parallel interface with outer devices, and the micro-computer 605 has a configuration connected with an outer EPROM 601 memory stored an application program via a bus 604, a RAM 602 for a working space which stores the calculation result when the application program is working, and a parallel input/output port 603 for inputting/outputting signal with the outer devices. And the micro-computer 605 is indirectly connected with the hall signal transmitting repeater and the elevator controller 101 via the wave shaping circuit 606, the pulse transformer 607, and the common transmission lines 608A, 608B.

Accordingly, a hall call signal input via the hall call button device 107C is successively output as a serial signal via a parallel signal interface 605G and a serial transmission interface 605B in the one-chip micro-computer 605, and a drive 605C, and then is successively transmitted to the elevator controller via the wave shaping circuit 606, the pulse transformer 607, and the serial transmission lines 608A, 608B as well.

Additionally, after the call answering signal transmitted from the elevator controller 101 is transmitted to the hall call button device 107C through the routine, the button lamp of the hall call button device 107C is lit-up. The driving state signal, such as a traveling direction lamp displaying information, a car position displaying information, and so on, transmitted from the elevator controller 101 is transmitted to the car position indicator 107B via the bus 604, and a parallel input/output port 603, so the customers who are waiting for an elevator on a floor can know a driving situation of the current elevator.

On the other hand, in FIG. 19 the car controllers 110A, 111A have a micro-computer 705 which is comprised of devices of an EEPROM 705E storing an information for a serial signal transmission, a RAM 705F for a working space which is needed for program working, a serial transmission interface 705B, a drive 705C and a receiver 705D for sending/receiving a serial signal, and a parallel signal interface 705G for parallel interface with outer devices, and the micro-computer 705 has a configuration connected with an outer EPROM 702 stores an application program via a bus 704, a RAM 701 for a working space which stores the calculation result when the application program is working, and a parallel input/output port 703 for inputting/outputting signal with the outer devices, respectively.

The micro-computer 705 transmits the call signal to the elevator controller 101 via the serial signal transmission line 708A, 708B after receiving the call signal from a car traveling operating panel 110C via the parallel input/output port 703, and transmits the call answering signal and driving state signal which are received from the elevator controller 101, for example, a traveling direction lamp displaying information, a car position display information, to the car traveling operating panel 110C and the car indicator 110B via the parallel input/output port 703.

The transmission line for transmitting signals between the floor controllers and the objects from the elevator controller and the transmission line for the signal transmission with the car devices are independently installed, respectively. And the common information is always transmitted to the respective devices via the transmission lines at every predetermined period of time, a signal from the floor devices or the car devices is only received, and the answering signal is only sent to the floor or the car devices which correspond to the received signal at predetermined transmission period of time according to the invention. By transmitting these signals, quick answering is acquired in the skyscraper and an express elevator. In addition, the quick answering is acquired in case that the control information for transmission to the outer devices and any information are transmitted, since the occurred signals are selectively processed according to the elevator usage situation. And when the elevator controller communicates serially with the plurality of floor controllers, the elevator controller does not communicate with the respective floor controller, but transmits the common information and the individual information. Therefore, there is an effect to send/receive lots of information quickly in an express elevator providing a sophisticated function or high quality without adding the extra devices.

What is claimed is:

1. An elevator control system for controlling an elevator car which travels along a plurality of floors in a building, the elevator control system comprising:

a plurality of car position indicators installed at each floor for displaying a current floor position information of the car;

a plurality of hall call buttons installed at each floor for enabling a user to call the car and having lamps therein for displaying a call when the call is registered;

a plurality of floor controllers each having group information memory means for storing a group identifier representing a group to which the floor controllers belong, floor controller identifier memory means for storing an identifier of the floor controller, and first processor means for controlling input/output of a floor information signal by generating and outputting a hall call signal responding to a hall call button pushed by the user and by receiving and outputting a car position information signal to the indicators for displaying, the floor controllers being installed at each floor and connected to the indicators installed at the same floor via a transmission line;

an elevator controller having group information memory means for storing the group identifiers stored in the floor controllers, floor controller identifier memory means for storing the identifier for each floor controller, timer means for outputting a timing signal for transmitting an information signal to the floor controllers in each predetermined period of time, second processor means for outputting an individual information signal for corresponding floors including an indicator lamp lighting signal for displaying a response to a hall call signal as well as a common information signal for all floors including the car position information signal whenever the output from the timer means is generated, group selecting signal generating means for generating a group information signal selected by the second processor means from among group information stored in the group information memory means of the elevator controller and providing the second processor means with the selected group information signal included in the individual information signal, and means for generating and outputting a failure check command signal for checking a failure of the floor controllers;

a hall signal transmitting repeater for sending the individual and common information signals received from the elevator controller and transmitting the information signal received from the floor controller; and a serial transmission line connected to the plurality of floor controllers commonly and providing a signal transmission line between the hall signal transmitting repeater and the plurality of floor controllers.

2. The elevator control system according to claim 1, wherein the common information signal is at least one of the car position information signal, a direction lighting signal for confirming an upward/downward traveling direction chosen by users, a car driving state information signal, a car load state information signal, and a car arrival forecasting information signal, and the individual information signal is at least one of the group information signal, a floor controller identifier signal, a lighting signal of a hall call button, and a hall call button checking command signal.

3. An elevator control system for controlling an elevator car which travels along a plurality of floors in a building, the elevator control system comprising:

a plurality of car position indicators installed at each floor for displaying a current floor position information of the car;

a plurality of hall call buttons installed at each floor for enabling a user to call the car and having lamps therein for displaying a call when the call is registered;

a plurality of floor controllers each having group information memory means for storing a group identifier representing a group to which the floor controllers belong, floor controller identifier memory means for storing an identifier of the floor controller, and first processor means for controlling input/output of a floor information signal by generating and outputting a hall call signal responding to a hall call button pushed by the user and by receiving and outputting a car position information signal to the indicators for displaying, the floor controllers being installed at each floor and connected to the indicators installed at the same floor via a transmission line;

an elevator controller having group information memory means for storing the group identifiers stored in the floor controllers, floor controller identifier memory means for storing the identifier for each floor controller, timer means for outputting a timing signal for transmitting an information signal to the floor controllers in each predetermined period of time, second processor means for outputting an individual information signal for corresponding floors including an indicator lamp lighting signal for displaying a response to a hall call signal as well as a common information signal for all floors including the car position information signal whenever the output from the timer means is generated, and group selecting signal generating means for generating a group information signal selected by the second processor means from among group information stored in the group information memory means of the elevator controller and providing the second processor means with the selected group information signal included in the individual information signal;

a hall signal transmitting repeater for sending the individual and common information signals received from the elevator controller and transmitting the information signal received from the floor controller; and a serial transmission line connected to the plurality of floor controllers commonly and providing a signal transmission line between the hall signal transmitting repeater and the plurality of floor controllers, the elevator controller further having data editing sequence memory means for storing an editing sequence for each data included in the common information signal depending on content of data.

4. An elevator control system for controlling an elevator car which travels along a plurality of floors in a buildings, the elevator control system comprising:

a plurality of car position indicators installed at each floor for displaying a current floor position information of the car;

a plurality of hall call buttons installed at each floor for enabling a user to call the car and having lamps therein for displaying a call when the call is registered;

a plurality of floor controllers each having group information memory means for storing a group identifier representing a group to which the floor controllers belong, floor controller identifier memory means for storing an identifier of the floor controller, and first processor means for controlling input/output of a floor information signal by generating and outputting a hall call signal responding to a hall call button pushed by the user and by receiving and outputting a car position information signal to the indicators for displaying, the floor controllers being installed at each floor and connected to the indicators installed at the same floor via a transmission line;

an elevator controller having group information memory means for storing the group identifiers stored in the floor controllers, floor controller identifier memory means for storing the identifier for each floor controller, timer means for outputting a timing signal for transmitting an information signal to the floor controllers in each predetermined period of time, second processor means for outputting an individual information signal for corresponding floors including an indicator lamp lighting signal for displaying a response to a hall call signal as well as a common information signal for all floors including the car position information signal whenever the output from the timer means is generated, and group selecting signal generating means for generating a group information signal selected by the second processor means from among group information stored in the group information memory means of the elevator controller and providing the second processor means with the selected group information signal included in the individual information signal;

a hall signal transmitting repeater for sending the individual and common information signals received from the elevator controller and transmitting the information signal received from the floor controller; and a serial transmission line connected to the plurality of floor controllers commonly and providing a signal transmission line between the hall signal transmitting repeater and the plurality of floor controllers, the floor controllers further having data editing sequence memory means for storing a same editing sequence data as an editing order data stored in the elevator controller.

5. The elevator control system according to claim 1, wherein a number of the floor controllers that belong to one group is 4.

6. The elevator control system according to claim 1, wherein a number of the floor controllers that belong to one group is 8.

7. The elevator control system according to claim 1, wherein a number of the floor controllers that belong to one group is predetermined depending on a number of floors along which the car travels.

8. An elevator control system for controlling an elevator car which travels along a plurality of floors in a building, the elevator control system comprising:

a plurality of car position indicators installed at each floor for displaying a current floor position information of the car;

a plurality of hall call buttons installed at each floor for enabling a user to call the car and having lamps therein for displaying a call when the call is registered;

a plurality of floor controllers each having group information memory means for storing a group identifier representing a group to which the floor controllers belong, floor controller identifier memory means for storing an identifier of the floor controller, and first processor means for controlling input/output of a floor information signal by generating and outputting a hall call signal responding to a hall call button pushed by the user and by receiving and outputting a car position information signal to the indicators for displaying, the floor controllers being installed at each floor and connected to the indicators installed at the same floor via a transmission line;

a car operating panel installed in the car and having a plurality of buttons and switches for designating car traveling operation;

indicator means installed in the car for displaying an information including a full load displaying information;

a plurality of car controllers each connected to a car operating panel and the indicator means of a corresponding car for outputting an information signal to the car operating panel and the indicator means and providing an output after receiving an information signal from the car operating panel and the indicator means, the car controllers having identifier memory means for storing an identifier information which is preset;

an elevator controller having first memory means for storing the group identifiers for each floor controller as stored in the floor controllers, second memory means for storing the identifier of each floor controller, first timer means for outputting a timing signal for transmitting an information signal to the floor controllers at each predetermined period of time, third memory means for storing a predetermined identifier information for each car controller, fourth memory means for storing a predetermined identifier information representing a content of a corresponding information signal to transmit to a car controller, second timer means for outputting a timing signal for transmitting the information signal to the car controllers at each predetermined period of time, second processor means for generating and outputting an indication information signal of the indicator means in a car as well as a responding signal to an operating input signal of a corresponding car operating panel and outputting the identifier information stored in the fourth memory means as well as the predetermined identifier information stored in the third memory means whenever a timing signal is received from the second timer means, third processor means for generating an individual information signal for each floor including a responding lamp lighting signal to a hall call signal as well as a common information signal for all floors including a car position information signal and outputting the individual and common information signals whenever the timing signal is received from the first timer means, and group selecting signal generating means for generating a corresponding group selecting signal which is chosen by the third processor means from among the group identifiers stored in the first memory means and providing the second processor means with the group selecting signal included in the individual information signal;

a hall signal transmitting repeater for sending the individual and common information signals received from the elevator controller and transmitting the information signal received from the floor controller to the elevator controller;

a first serial transmission line connected to the plurality of the floor controllers commonly for providing a signal transmission line between the hall signal transmitting repeater and the plurality of the floor controllers;

a car signal transmitting repeater for sending the individual and common information signals received from the elevator controller and transmitting the information signal received from the plurality of car controllers to the elevator controller; and a second serial transmission line connected to the plurality of car controllers commonly, for providing a signal transmission line between the car signal transmitting repeater and the plurality of the car controllers.

9. The elevator control system according to claim 8, wherein the elevator controller further comprises means of generating and outputting a failure checking command signal for checking failure of the floor controllers.

10. The elevator control system according to claim 8, wherein the common information signal is at least one of the car position information signal, a direction lighting signal for confirming an upward/downward traveling direction chosen by users, a car driving state information signal, a car load state information signal, and a car arrival forecasting information signal, and the individual information signal is at least one of a group information signal, a floor controller identifier signal, a lighting signal of a hall call button, and a hall call button checking command signal.

11. The elevator control system according to claim 8, wherein the elevator controller further comprises data editing sequence memory means for storing an editing sequence for each data included in the common information signal depending on content of data.

12. The elevator control system according to claim 8, wherein the floor controllers further comprise data editing sequence memory means for storing a same editing sequence data as an editing sequence data stored in the elevator controller.

13. The elevator control system according to claim 8, wherein a number of the floor controllers that belong to one group is 4.

14. The elevator control system according to claim 8, wherein a number of the floor controllers that belong to one group is 8.

15. The elevator control system according to claim 8, wherein a number of the floor controllers that belong to one group is predetermined depending on a number of the floors along which the car travels.

16. The elevator control system according to claim 8, wherein the elevator controller further comprises check data signal generating means for generating and outputting a varying check signal whenever an information signal is transmitted to check a failure of the car controllers.

17. The elevator control system according to claim 8, wherein an information signal which the elevator controller transmits to a car controller is at least one of a responding signal to an operating input signal of a car operating panel, a failure check command signal for a car operating panel or an indicator means, a current position information signal of the car, and a guide information indicating signal of each floor.

18. The elevator control system according to claim 8, wherein the car controllers further comprise timer means in which a time-up is set in order that a timing for sending an information signal to the car signal transmitting repeater via the second serial transmission line is different, respectively.

19. The elevator control system according to claim 9, wherein the elevator controller further comprises check data signal generating means for generating and outputting a varying check signal to check failure of the car controllers and the car controllers further comprise output means for outputting an information signal which transmits at a current time by including a check signal received at a previous time if the corresponding car controller is normal.

20. An elevator control system for controlling a pair of elevator cars which travel along a plurality of floors in a building, the elevator control system comprising:

a pair of car position indicators installed at each floor for displaying a current floor position information of a pair of cars;

a plurality of hall call buttons installed at each floor commonly to the two cars for enabling a user to call a car and having lamps therein for displaying a call when the call is registered;

a plurality of floor controllers each having group information memory means for storing a group identifier information representing a group to which the floor controllers being, floor controller identifier memory means for storing an identifier information of the floor controller, and first processor means for controlling input/output of a floor information signal by generating and outputting a hall call signal responding to a hall call button pushed by the user and by receiving and outputting a car position information signal to the indicators, the floor controllers being installed at each floor and connected to the indicators installed at the same floor via a transmission line;

a car operating panel installed in each car and having a plurality of buttons and switches for designating car traveling operations;

a car indicator installed in each car for displaying an information including a full load displaying information;

a first car controller group and a second car controller group including a plurality of car controllers connected to the car operating panels and the car indicators for outputting an information signal to the car operating panels and the car indicators or for receiving an information signal from the car operating panels and the car indicators, wherein each car controller has identifier information memory means for storing a predetermined identifier information;

a pair of elevator controllers, each having first memory means for storing the group identifier information as stored in the floor controllers, second memory means for storing the floor controller identifier information for each floor controller, first timer means for outputting a timing signal for transmitting the information signal to the floor controllers at each predetermined period of time, third memory means for storing a car controller identifier information which is predetermined for each car controller, fourth memory means for storing a predetermined identifier information representing a content of a corresponding information signal to transmit to a car controller, second timer means for outputting a timing signal for transmitting the information signal to the car controllers at each predetermined period of time, second processor means for generating and outputting the predetermined identifier information stored in the fourth memory means as well as the car controller identifier information stored in the third memory means whenever a timing signal is received from the second timer means together with an indicating information signal of the car indicator as well as a responding signal to an operating input signal from the car operating panel, third processor means for outputting an individual information signal whenever a timing signal is received from the first timer means by generating the individual information signal for each floor including a hall call lamp lighting signal displaying a registration for the hall call signal as well as a common information signal for all floors including the car position information signal, and group selecting signal generating means for providing a group selecting signal to the second processor means to be included in the individual information signal by generating the corresponding group selecting signal which is chosen by the third processor means among the group identifier information stored in the first memory means;

a pair of hall signal transmitting repeaters, each of which transmits the information signal received from one elevator controller to another elevator controller and transmits the information signal received from the another elevator controller to the one elevator controller while transmitting the information signal received from a floor controller to the respective elevator controller;

a first serial transmission line for providing a signal transmission line between the pair of the hall signal transmitting, repeaters and the plurality of floor controllers and for connecting a plurality of the floor controllers and the pair of the hall signal transmitting repeaters commonly;

a pair of car signal transmitting repeaters for transmitting the individual and common information signals received from the elevator controllers to the corresponding car controller respectively, and transmitting the information signal received from the plurality of car controllers to the elevator controllers; and second and third serial transmission lines to which the plurality of car controllers in the first and the second car controller groups are connected commonly, for providing the second and the third serial transmitting lines between the car signal transmitting repeaters and the plurality of car controllers, respectively.

21. The elevator control system according to claim 20, wherein each elevator controller further comprises means for generating and outputting a failure checking command signal for checking failure of the floor controllers.

22. The elevator control system according to claim 20, wherein the common information signal is at least one of the car position information signal, a direction lighting signal for confirming an upward/downward traveling direction chosen by users, a car driving state information signal, a car load state information signal, and a car arrival forecasting information signal, and the individual information signal is at least one of a floor controller group information signal, a floor controller identifier signal, a lighting signal of a hall call button, and a hall call button checking command signal.

23. The elevator control system according to claim 20, wherein each elevator controller further comprises data editing sequence memory means for storing an editing sequence for each data included in the common information signal depending on content of data.

24. The elevator control system according to claim 20, wherein each floor controller further comprises data editing sequence memory means for storing a same editing sequence data as an editing sequence data stored in the pair of elevator controllers.

25. The elevator control system according to claim 20, wherein each elevator controller further comprises check data signal generating means for generating and outputting a varying check signal whenever an information signal is transmitted for checking a failure of the car controllers.

26. The elevator control system according to claim 20, wherein an information signal which an elevator controller transmits to a car controller is at least one of a responding signal to an operating input signal from a car operating panel, a failure checking command signal of a car operating panel or a car indicator, a current position information signal of a car, and a guide information indicating signal of each floor.

27. The elevator control system according to claim 20, wherein each car controller further comprises timer means in which a time-up is set in order that a timing for transmitting an information signal to a car signal transmitting repeater via the second serial transmission line is different, respectively.

28. The elevator control system according to claim 20, wherein each elevator controller further comprises check data signal generating means for generating and outputting a varying check signal whenever an information signal is transmitted to check a failure of the car controllers, and each car controller further comprises output means for outputting an information signal which is to be sent at a current time by including the check signal received at a previous time if the car controller is normal.

29. The elevator control system according to claim 20, wherein a number of the floor controllers that belong to one group is 4.

30. The elevator control system according to claim 20, wherein a number of the floor controllers that belong to one group is 8.

31. The elevator control system according to claim 20, wherein a number of the floor controllers set in one group is preset on the basis of a number of the traveling floors along which a car travels.

32. An elevator control system for controlling a plurality of elevator cars which travel commonly along a plurality of floors in a building, the elevator control system comprising:

a plurality of car position indicators installed at each floor for displaying a current floor position information of the cars;

a plurality of hall call buttons installed at each floor for enabling a user to call a car and having lamps therein for displaying a call when the call is registered;

a plurality of floor controllers each having group information memory means for storing a group identifier information representing a group to which the floor controllers belong, floor controller identifier memory means for storing an identifier information of the floor controller, and first processor means for controlling input/output of a floor information signal by generating and outputting a hall call signal responding to a hall call button pushed by the user and by receiving and outputting a car position information signal to the indicators, the floor controllers being installed at each floor and connected to the indicators installed at the same floor via a transmission line;

a car operating panel installed in each car and having a plurality of buttons and switches for designating car traveling operation;

a car indicator installed in each car for displaying an information including a full load displaying information;

a plurality of car controller groups each including a plurality of car controllers connected to the car operating panels and the car indicates for outputting an information signal to the car operating panels and the car indicators or for receiving an information signal from the car operating panels and the car indicators, wherein each car controller has identifier information memory means for storing a predetermined identifier information;

a plurality of elevator controllers, each having first memory means for storing the group identifier information as stored in the floor controllers, second memory means for storing the floor controller identifier information for each floor controller, first timer means for outputting a timing signal for transmitting the information signal to the floor controllers at each predetermined period of time, third memory means for storing a car controller identifier information which is predetermined for each car controller, fourth memory means for storing a predetermined identifier information representing a content of a corresponding information signal to transmit to a car controller, second timer means for outputting a timing signal for transmitting the information signal to the car controllers at each predetermined period of time, second processor means for generating and outputting the predetermined identifier information stored in the fourth memory means as well as the car controller identifier information stored in the third memory means whenever a timing signal is received from the second timer means together with an indicating information signal of the car indicator as well as a responding signal to an operating input signal from the car operating panel, third processor means for outputting an individual information signal whenever a timing signal is received from the first timer means by generating the individual information signal for each floor including a hall call lamp lighting signal displaying a registration for the hall call signal as well as a common information signal for all floors including the car position information signal, and group selecting signal generating means for providing a group selecting signal to the second processor means to be included in the individual information signal by generating the corresponding group selecting signal which is chosen by the third processor means among the group identifier information stored in the first memory means;

a plurality of hall signal transmitting repeaters for transmitting the information signal received from one elevator controller to another elevator controller while transmitting the information signal received from the another elevator controller to the one elevator controller and transmitting the information signal received from a floor controller to an elevator controller;

a plurality of first serial transmission lines connected to the plurality of the floor controllers and the hall signal transmitting repeaters commonly, for providing a signal transmission line between the hall signal transmitting repeaters and the floor controllers;

a plurality of car signal transmitting repeaters for sending an information signal received from the elevator controllers to the corresponding car controller respectively and transmitting the information signal received from the plurality of car controllers to the elevator controllers;

a group managing controller having car assigning means for outputting an assigning signal by choosing a car to service to a received hall call signal among a plurality of cars according to a priority which is determined by a predetermined assigning program;

a group managing signal repeater for transmitting the hall call signal to the group managing controller and for outputting the assigning signal received from the group managing controller;

a third hall signal transmitting repeater for relaying an information signal between the group managing signal repeater and the plurality of hall signal transmitting repeaters for relaying the information signal transmission between them;

a third serial communication line for providing a common signal transmitting line between the third hall signal transmitting repeater and the plurality of hall signal transmitting repeaters; and a fourth serial communication line for providing a common signal transmitting line between the group managing signal repeater and the plurality of hall signal transmitting repeaters by being connected commonly.

* * * * *